US010889307B2

(12) United States Patent
Sakaki et al.

(10) Patent No.: US 10,889,307 B2
(45) Date of Patent: Jan. 12, 2021

(54) DOOR DEVICE AND VEHICLE HAVING THE SAME

(71) Applicant: NABTESCO CORPORATION, Tokyo (JP)

(72) Inventors: Genta Sakaki, Kobe (JP); Hitoshi Akiyama, Kobe (JP)

(73) Assignee: Nabtesco Corporation, Tokyo (JP)

( * ) Notice: Subject to any disclaimer, the term of this patent is extended or adjusted under 35 U.S.C. 154(b) by 109 days.

(21) Appl. No.: 15/912,108

(22) Filed: Mar. 5, 2018

(65) Prior Publication Data

US 2018/0257674 A1 Sep. 13, 2018

(30) Foreign Application Priority Data

Mar. 8, 2017 (JP) ..... 2017-044310

(51) Int. Cl.

| | |
|---|---|
| ***E05F 11/52*** | (2006.01) |
| ***B61D 19/00*** | (2006.01) |
| ***B61D 19/02*** | (2006.01) |
| ***E06B 1/52*** | (2006.01) |
| ***E06B 1/70*** | (2006.01) |
| ***E06B 7/23*** | (2006.01) |

(52) U.S. Cl.

CPC ..... *B61D 19/003* (2013.01); *B61D 19/008* (2013.01); *B61D 19/02* (2013.01); *E06B 1/52* (2013.01); *E06B 1/70* (2013.01); *E06B 7/23* (2013.01)

(58) Field of Classification Search

CPC .... B61D 19/003; B61D 19/02; B61D 19/008; E06B 1/52; E06B 1/70; E06B 7/23

USPC ..... 49/209, 210, 211, 213

See application file for complete search history.

(56) References Cited

U.S. PATENT DOCUMENTS

| | | | | |
|---|---|---|---|---|
| 3,384,995 A * | 5/1968 | Furrer | B60J 5/062 | 49/213 |
| 4,176,999 A * | 12/1979 | Thorley | B60P 1/4421 | 105/447 |
| 5,261,779 A * | 11/1993 | Goodrich | B60P 1/4442 | 414/546 |
| 5,263,280 A * | 11/1993 | Dilcher | B61D 19/009 | 49/212 |

(Continued)

FOREIGN PATENT DOCUMENTS

| | | |
|---|---|---|
| DE | 20015593 U1 | 12/2000 |
| EP | 0420835 A2 | 4/1991 |

(Continued)

OTHER PUBLICATIONS

Extended European Search Report EP Application No. 18160614.6 dated Jul. 23, 2018.

*Primary Examiner* — Jerry E Redman

(74) *Attorney, Agent, or Firm* — Pillsbury Winthrop Shaw Pittman, LLP

(57) ABSTRACT

The door device is provided with an opening frame defining an opening and a door for operating between a first door position and a second door position, the door making contact with the opening frame when at the first door position, the door being separated from the opening frame when at the second door position. A movable receiving portion constituted by at least part of the opening frame operates so that the opening is larger when the door is at the second door position than when the door is at the first door position.

15 Claims, 21 Drawing Sheets

(56) References Cited

U.S. PATENT DOCUMENTS

| | | | | | |
|---|---|---|---|---|---|
| 5,628,274 | A * | 5/1997 | Biedenweg | B63B 21/00 | 114/362 |
| 5,676,515 | A * | 10/1997 | Haustein | B60P 1/431 | 14/69.5 |
| 5,871,329 | A * | 2/1999 | Tidrick | A61G 3/061 | 14/71.3 |
| 5,893,236 | A * | 4/1999 | Krbec | B61D 19/008 | 49/118 |
| 5,993,135 | A * | 11/1999 | Wolgamood | B60P 1/43 | 296/61 |
| 6,179,545 | B1 * | 1/2001 | Petersen, Jr. | A61G 3/061 | 14/71.7 |
| 6,385,910 | B1 * | 5/2002 | Smink | B60J 5/062 | 49/218 |
| 7,445,416 | B2 * | 11/2008 | O'Leary | B60P 1/4442 | 414/546 |
| 8,225,552 | B2 * | 7/2012 | Yokomori | B60J 5/06 | 296/155 |
| 8,701,348 | B2 * | 4/2014 | Ito | E05D 15/0621 | 49/360 |
| 8,984,810 | B2 * | 3/2015 | Bortoluzzi | E05D 15/1042 | 312/139 |
| 10,328,955 | B2 * | 6/2019 | Yamaguchi | B61D 19/005 | |
| 2006/0225357 | A1 * | 10/2006 | Bortoluzzi | E05D 15/10 | 49/213 |

FOREIGN PATENT DOCUMENTS

| | | | |
|---|---|---|---|
| FR | 2485077 | A1 | 12/1981 |
| GB | 664862 | | 1/1952 |
| JP | 2002-180731 | A2 | 6/2002 |

* cited by examiner

DOOR DEVICE AND VEHICLE HAVING THE SAME

CROSS-REFERENCE TO RELATED APPLICATIONS

This application is based on and claims the benefit of priority from Japanese Patent Application Serial No. 2017-044310 (filed on Mar. 8, 2017), the contents of which are hereby incorporated by reference in their entirety.

TECHNICAL FIELD

The present invention relates to a door device and a vehicle having the same.

BACKGROUND

Conventionally, there is known a plug door device installed at an opening of a vehicle such as a railway vehicle. When a door is opened or closed, the plug door device causes the door to move in a width direction of the vehicle. In a case of using the above-mentioned plug door device, in order to increase airtightness inside the vehicle, it is required that a seal surface be provided in a peripheral region of the opening of the vehicle, the peripheral region being directly opposed to the door. In such a case, the opening is narrowed by the region in which the seal surface is provided, resulting in obstructing passage of a human or movement of an object through the opening.

SUMMARY

The present invention has been made in view of such circumstances, and it is an object of the present invention to provide a door device capable of widening an opening when a door is opened.

A door device according to the present invention is provided with an opening frame defining an opening, and a door for operating between a first door position and a second door position, the door making contact with the opening frame when at the first door position, the door being separated from the opening frame when at the second door position, wherein a movable receiving portion constituted by at least part of the opening frame operates so that the opening is larger when the door is at the second door position than when the door is at the first door position.

In this case, when the door being at the second door position moves to the first door position, the movable receiving portion may operate so as to narrow the opening.

Furthermore, the movable receiving portion may operate in accordance with an operation of the door between the first door position and the second door position.

The door device according to the present invention may be provided further with a plug operation portion for operating the door between the first door position and the second door position, and a transmission unit provided between either the plug operation portion or the door and the movable receiving portion of the opening frame, the transmission unit transmitting an operation of either the plug operation portion or the door to the movable receiving portion.

In the door device according to the present invention, when the door moves from the first door position to the second door position, the movable receiving portion of the opening frame may start an operation after the door has started an operation from the first door position and moved a given distance.

In the door device according to the present invention, when the door moves from the first door position to the second door position, the movable receiving portion of the opening frame may end an operation before the door reaches the second door position.

In the door device according to the present invention, when the door moves from the second door position to the first door position, the movable receiving portion of the opening frame may end an operation before the door reaches the first door position.

In the door device according to the present invention, the movable receiving portion may be rotatable about an axis non-parallel to a moving direction of the door between the first door position and the second door position.

In the door device according to the present invention, the movable receiving portion may be rotatable about an axis along an extending direction of the opening frame.

In the door device according to the present invention, a configuration may be adopted in which the opening frame includes a door receiving plate portion forming a receiving surface, the receiving surface coming in contact with the door being at the first door position, and a support portion connected to the door receiving plate portion, and the movable receiving portion constitutes part of the door receiving plate portion and is operable between a first receiving portion position and a second receiving portion position, the movable receiving portion standing from the support portion when at the first receiving portion position, the movable receiving portion being lowered when at the second receiving portion position.

In this case, a configuration may be adopted in which the door receiving plate portion further includes a stationary receiving portion maintained in a stationary state while the door operates between the first door position and the second door position, and when the door is at the first door position, an end portion of the stationary receiving portion along an extending direction of the opening frame and an end portion of the movable receiving portion along the extending direction are directly opposed to each other in a moving direction of the door operating between the first door position and the second door position.

In this case, a seal member may be provided between the end portion of the stationary receiving portion and the end portion of the movable receiving portion.

In the door device according to the present invention, the movable receiving portion being at the first receiving portion position may be tightly attached to the support portion in a region along an extending direction of the opening frame.

The door device according to the present invention may be used for a vehicle.

A vehicle according to the present invention is provided with a vehicle body, and the above-mentioned door device installed in the vehicle body.

According to the present invention, it is possible to widen the opening when the door is opened. Therefore, when the door is closed, airtightness of the vehicle body can be obtained by providing, at a periphery of the opening, a region that makes contact with the door, while when the door is opened, passage of a human or movement of an object through the opening can be facilitated by widening the opening.

DESCRIPTION OF THE PREFERRED EMBODIMENTS

Figure 1:
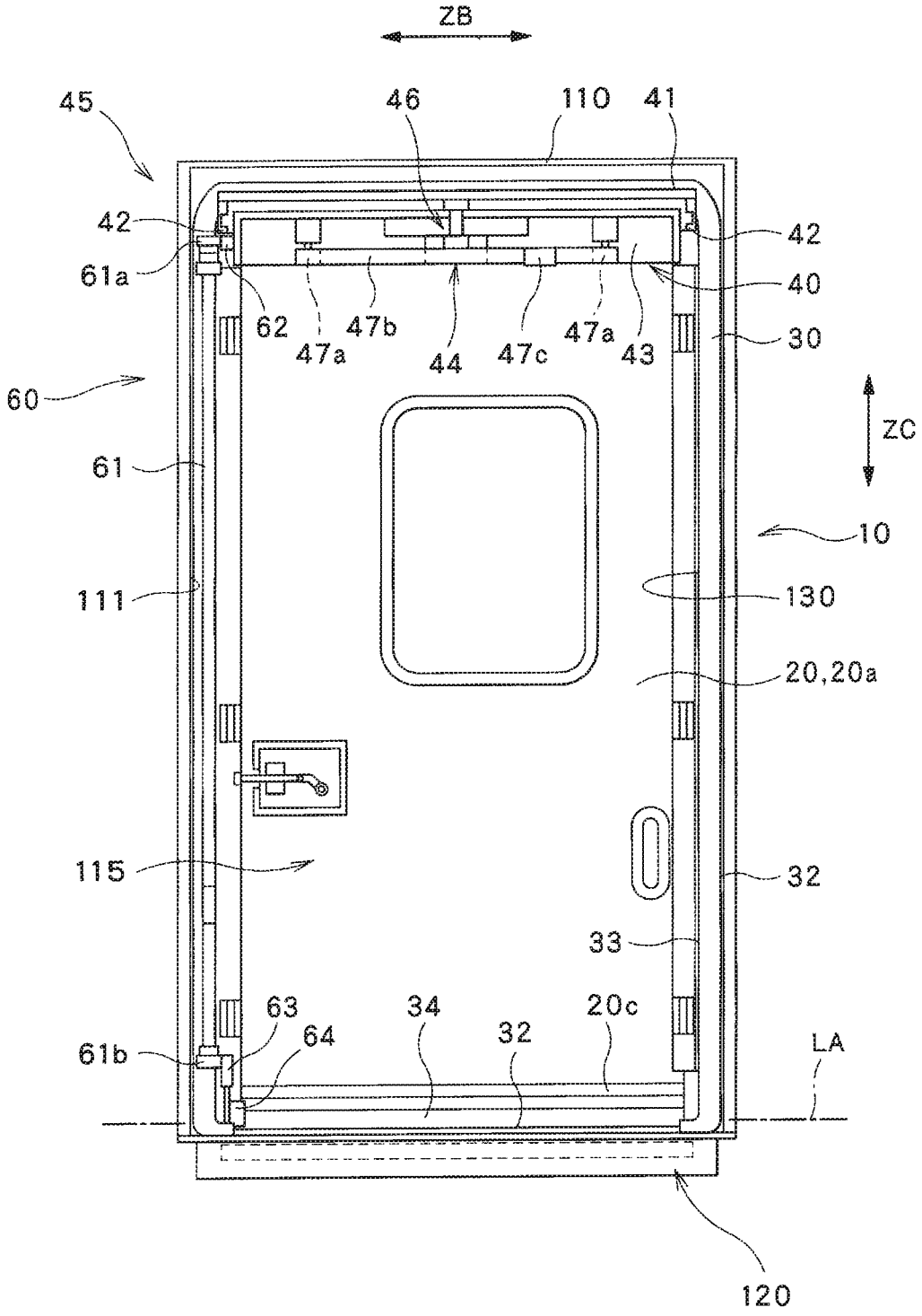
FIG. 1 illustrates an embodiment of the present invention, showing a front view of a door device.
Figure 2A:
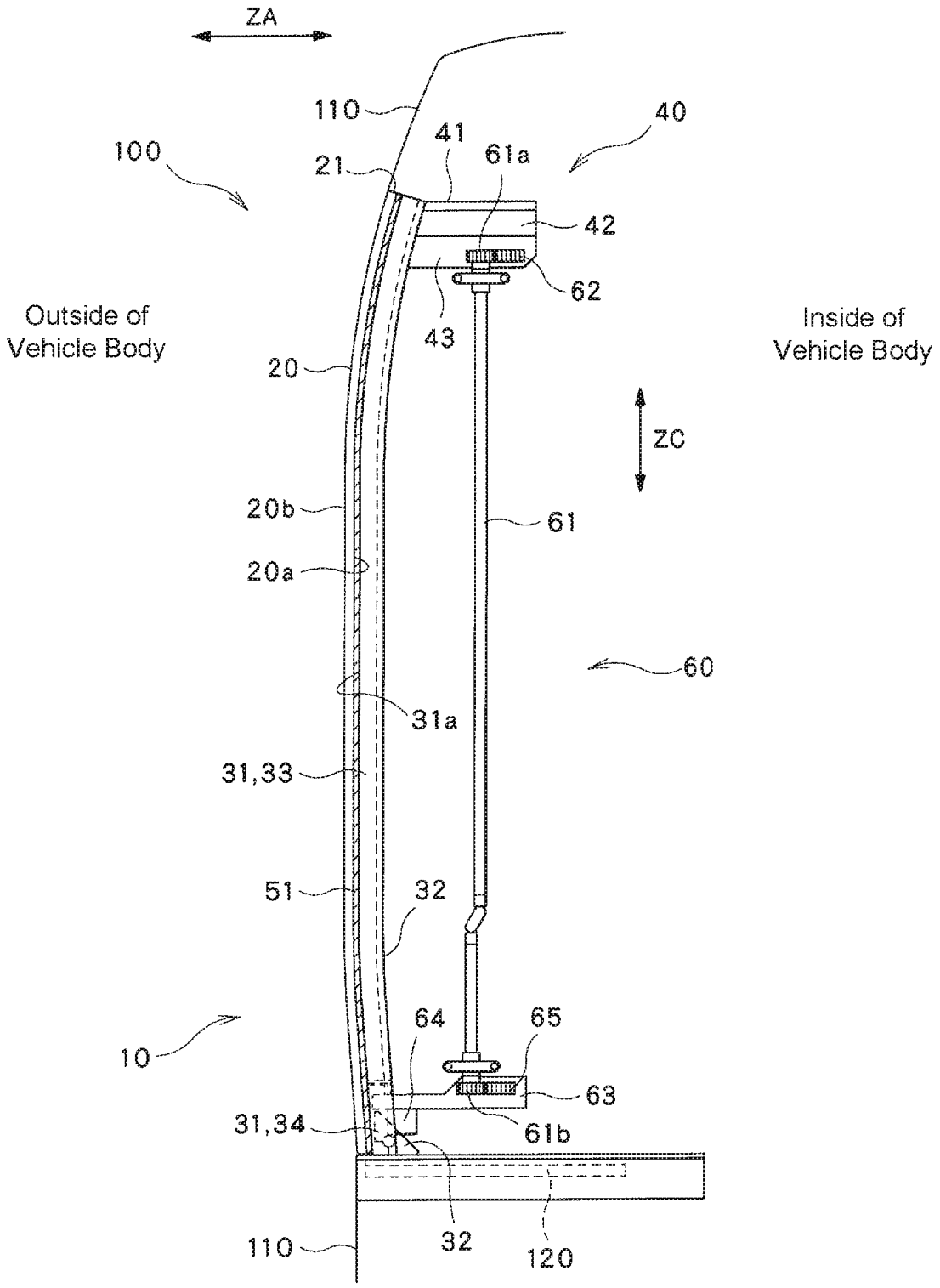
FIG. 2A is a side view showing the door device in which a door shown in FIG. 1 is at a first door position.
Figure 2B:
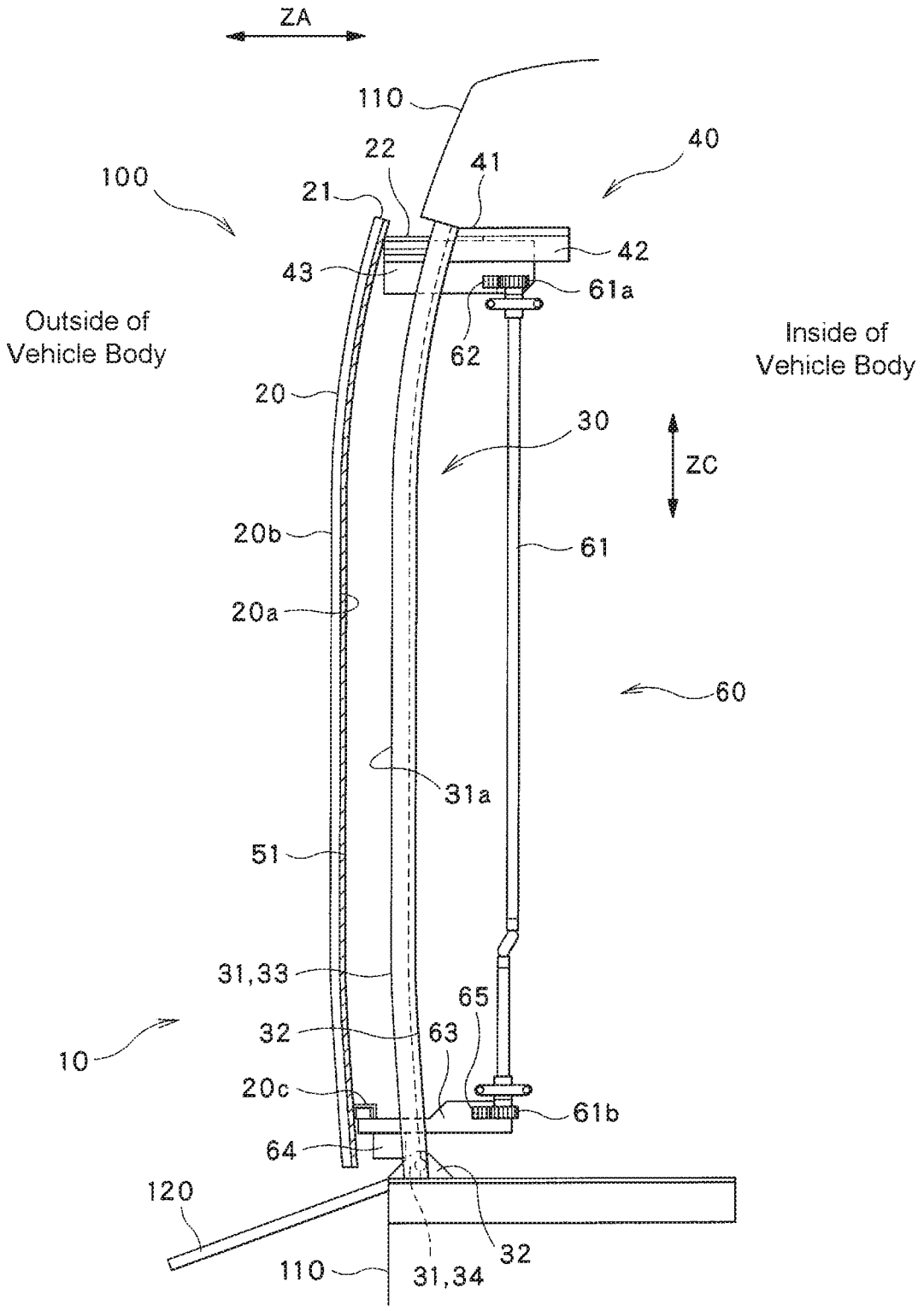
FIG. 2B is a side view showing the door device in which the door is at a second door position.

An embodiment of the present invention will now be described with reference to the appended drawings. FIG. 1 is a plan view of a door device according to this embodiment. FIG. 2A and FIG. 2B are side views of a railway vehicle having a vehicle body with the door device shown in FIG. 1 installed therein.

As shown in FIG. 1, a railway vehicle 100 has a vehicle body 110 and a door device 10 installed in the vehicle body 110. The door device 10 according to this embodiment is a so-called plug door device in which a door 20 can be moved in a width direction (hereinafter, a "vehicle width direction") ZA (see FIG. 2A) of the vehicle body 110. Specifically, in the door device 10 according to this embodiment, the door 20 is operated between a first door position shown in FIG. 2A (see FIG. 2A) and a second door position shown in FIG. 2B. In the door device 10 according to this embodiment, the door 20 is further operated in a front-rear direction (hereinafter, a "front-rear direction") ZB of the vehicle body 110 from the second door position shown in FIG. 2B.

Furthermore, as shown in FIG. 1 and FIG. 2A, on a lower side of the door device 10, a boarding/alighting assisting step board 120 is housed. At the time of boarding/alighting of passengers of the railway vehicle 100, the boarding/alighting assisting step board 120 is stretched between the vehicle body 110 and a platform (not shown) so as to assist the passengers in their boarding/alighting. As shown in FIG. 2B, when the door 20 is opened, the boarding/alighting assisting step board 120 is drawn out from inside the vehicle body 110 toward the platform, and when the door 20 is closed, the boarding/alighting assisting step board 120 is drawn into the vehicle body 110.

With reference to FIG. 1 to FIG. 4, the following describes in detail the door device according to this embodiment.

In an example shown in FIG. 1 to FIG. 4B, the door device 10 has the door 20, a circumferential opening frame 30 fixed to the vehicle body 110, a fixed base 41 fixed to the vehicle body 110 in an area above an opening 130 defined by the opening frame 30, a plug operation portion 45 that operates the door 20 in the vehicle width direction ZA, a front-rear operation portion 47 that operates the door 20 in the front-rear direction ZB, and a door driver 44 as a drive source that drives the plug operation portion 45 and the front-rear operation portion 47. The plug operation portion 45 has an upper slide member 43 slidable in the vehicle width direction ZA with respect to the fixed base 41, a pair of rails 42 that supports the upper slide member 43 so that the upper slide member 43 is slidable in the vehicle width direction ZA, an upper plug operation portion 46 that operates the upper slide member 43 in the vehicle width direction ZA, and a lower plug operation portion 60 that transmits an operation of the upper slide member 43 to a lower portion of the door 20. The plug operation portion 45 causes the door 20 to perform an operation (hereinafter, a "plug operation") between a first door position (see FIG. 2A) at which the door 20 makes contact with the opening frame 30 and a second door position (see FIG. 2B) at which the door 20 is separated from the opening frame 30.

Particularly, the door device 10 described here is so designed that in a case where the door 20 being at the first door position is opened, a movable receiving portion 34 constituted by at least part of the opening frame 30 operates so as to widen the opening 13 defined by the opening frame 30. Thus, a doorway 115 can be increased in wideness, thus making it possible to facilitate moving in and out via the door device 10. Hereinafter, a description will be given of an example in which the door device 10 is applied to the railway vehicle 100. It is to be noted, however, that without any limitation to this application example, the door device 10 can be broadly applied to various uses such as, for example, a door to a factory required to achieve airtightness (a door constituting a doorway of a refrigeration factory). Further, in various applications, it is also possible to enjoy an advantage of being able to facilitate moving in and out via the door device 10.

As is understood from FIG. 2A and FIG. 2B, the door device 10 according to this embodiment is a so-called outside plug type door device. Consequently, when the door 20 moves from the first door position at which the door 20 makes contact with the opening frame 30 to the second door position at which the door 20 is separated from the opening frame 30, the door 20 moves in a direction from inside of the vehicle body 110 toward outside thereof. On the other hand, when the door 20 moves from the second door position to the first door position, the door 20 moves in a direction from outside of the vehicle body 110 toward inside thereof.

As shown in FIG. 1, above the opening 130, the fixed base 41 extends along an upper edge of the opening 130. The pair of rails 42 is fixed to both ends of a bottom surface of the fixed base 41 in the front-rear direction ZB of the vehicle body 110. The pair of rails 42 extends in the vehicle width direction ZA. In a height direction (hereinafter, a "height direction") ZC of the vehicle body 110, a gap is provided between the upper slide member 43 and the fixed base 41, the upper slide member 43 being supported by the pair of rails 42 described above.

Figure 3:
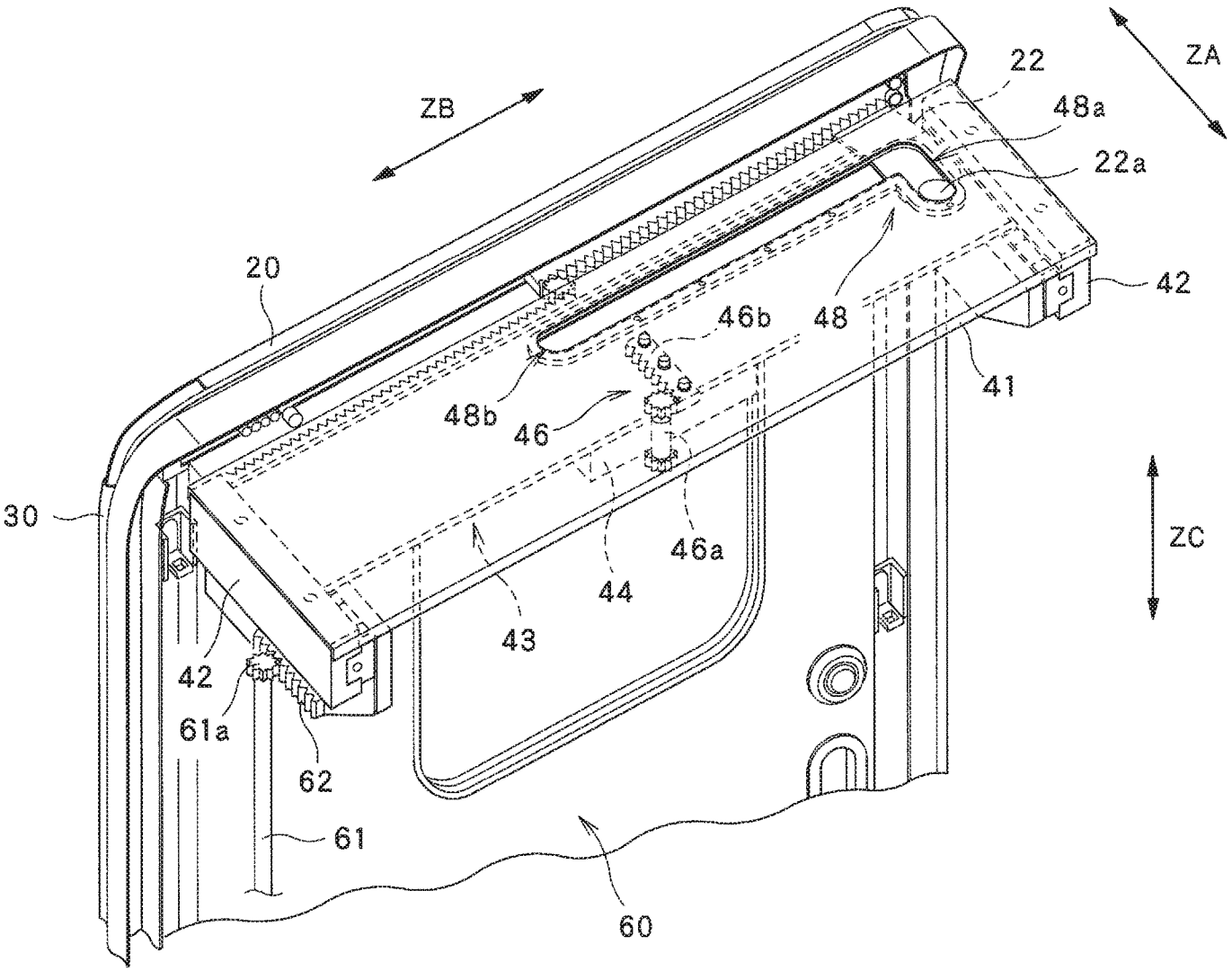
FIG. 3 is a perspective view, on a planar side, of the door device shown in FIG. 1.

As shown in FIG. 3, a door guide hole 48 for restricting motion of the door 20 is provided in the fixed base 41. The door guide hole 48 as a whole is L-shaped and has a width direction portion 48*a* extending in the vehicle width direction ZA and a front-rear direction portion 48*b* extending in the front-rear direction ZB. As will be mentioned later, by the door guide hole 48 described above, an operation of the door 20 in the vehicle width direction ZA or in the front-rear direction ZB is restricted.

As is understood from FIG. 2A and FIG. 2B, the door 20 has dimensions corresponding to dimensions of the opening 130 so as not to interfere with an operation of drawing out/in the boarding/alighting assisting step board 120. The door 20 has an inner surface 20*a* facing inside of the vehicle body 110 and an outer surface 20*b* facing outside of the vehicle body 110. On the inner surface 20*a* of the door 20, a seal member 51 is provided circumferentially along an edge portion 21 of the door 20.

As shown in FIG. 3, a door coupling member 22 extending in the vehicle width direction ZA is fixed to an upper portion of the door 20. The door coupling member 22 is inserted into the gap between the upper slide member 43 and the fixed base 41. In this manner, the door 20 is suspended from between the upper slide member 43 and the fixed base 41.

A shaft member 22*a* extending in the height direction ZC is provided at an end portion of the door coupling member 22 on an opposite side to the door 20. The shaft member 22*a* is disposed within the door guide hole 48 provided in the fixed base 41. Thus, an operation of the door 20 is restricted in the vehicle width direction ZA or in the front-rear direction ZB.

The door driver 44 is provided on a bottom surface of the upper slide member 43 and includes a motor (not shown) and a planetary gear mechanism (not shown) that transmits a driving force of the motor to the plug operation portion 45 and to the front-rear operation portion 47. While the shaft member 22*a* of the door coupling member 22 is in the width direction portion 48*a* of the door guide hole 48, the door driver 44 distributes a driving force to the plug operation portion 45, and while the shaft member 22*a* of the door coupling member 22 is in the front-rear direction portion 48*b* of the door guide hole 48, the door driver 44 distributes a driving force to the front-rear operation portion 47. The plug operation portion 45 is driven by the door driver 44 described above, and thus the door 20 can perform a plug operation in the vehicle width direction ZA between the first door position shown in FIG. 2A and the second door position shown in FIG. 2B. Furthermore, the front-rear operation portion 47 is driven by the door driver 44 described above, and thus the door 20 being at the second door position is moved in the front-rear direction ZB so that the opening 130 defined by the opening frame 30, accordingly, the doorway 115 (corresponding to a boarding/alighting port in this example in which the present invention is applied to the railway vehicle 100) is exposed.

The upper plug operation portion 46 of the plug operation portion 45 is driven by the door driver 44 to operate the upper slide member 43 in the vehicle width direction ZA. The upper plug operation portion 46 has a rotary portion 46*a* rotatably fixed to the upper slide member 43 and a rack 46*b* fixed to a bottom surface of the fixed base 41 and extending in the vehicle width direction ZA. The rotary portion 46*a* is caused to rotate by the door driver 44. The rack 46*b* is meshed with a pinion provided on the rotary portion 46*a*. Consequently, the upper slide member 43 moves in the vehicle width direction ZA as the rotary portion 46*a* rotates.

The lower plug operation portion 60 of the plug operation portion 45 transmits motion of the upper slide member 43 to the lower portion of the door 20. The lower plug operation portion 60 has a shaft 61 extending in the height direction ZC from the upper slide member 43 to a lower region of the door 20, a lower slide member 63 provided in the lower region of the door 20, a roller 63*a* (see FIG. 6A, etc.) provided at an end portion of the lower slide member 63 near the door 20, and a roller rail 20*c* provided on the door 20 along the front-rear direction ZB of the vehicle body 110.

The shaft 61 is rotatably retained to a wall surface 111 of the vehicle body 110. The shaft 61 has a first pinion 61*a* fixed at one end portion thereof and a second pinion 61*b* fixed to the other end thereof.

A first rack 62 is provided on a side surface of the upper slide member 43 so as to be meshed with the first pinion 61*a* of the shaft 61. The first rack 62 extends along a moving direction (the vehicle width direction ZA) of the upper slide member 43 and causes the shaft 61 to rotate via the first pinion 61*a* in accordance with motion of the upper slide member 43.

The lower slide member 63 is provided on the wall surface 111 of the vehicle body 110 so as to be opposed to the second pinion 61*b* of the shaft 61. The lower slide member 63 is provided so as to be slidable in the vehicle width direction ZA. The lower slide member 63 has a second rack 65 provided so as to be meshed with the second pinion 61*b*. The second rack 65 extends along the vehicle width direction ZA and causes the lower slide member 63 to move in the vehicle width direction ZA in accordance with rotation of the shaft 61, i.e. in accordance with rotation of the second pinion 61*b*.

Figure 6A:
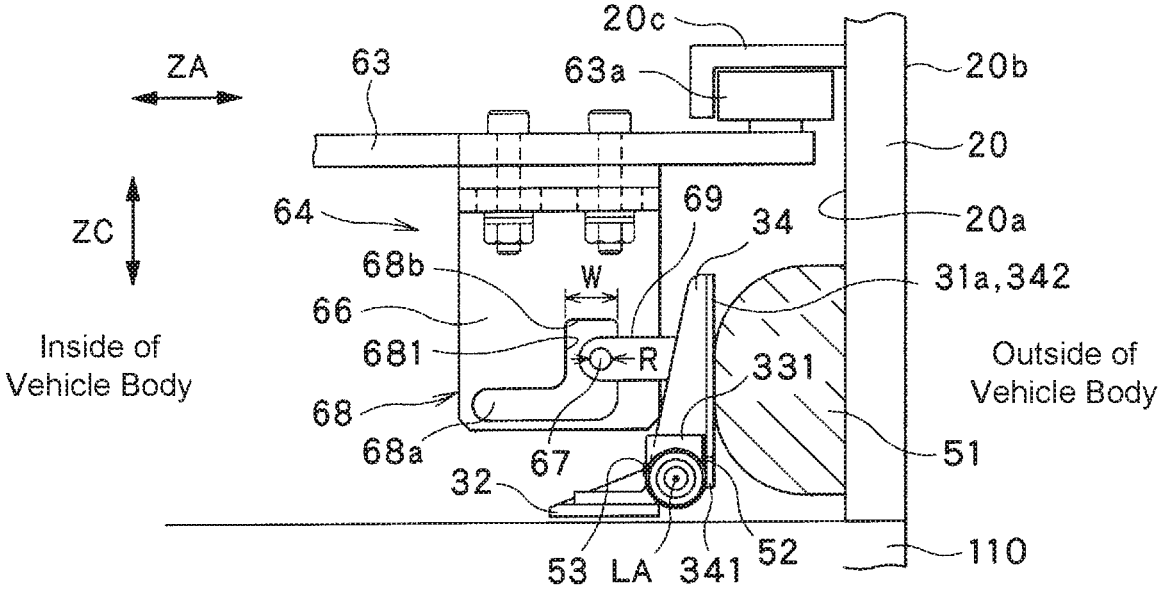
FIG. 6A is a side view showing the movable receiving portion being at the first receiving portion position.
Figure 6B:
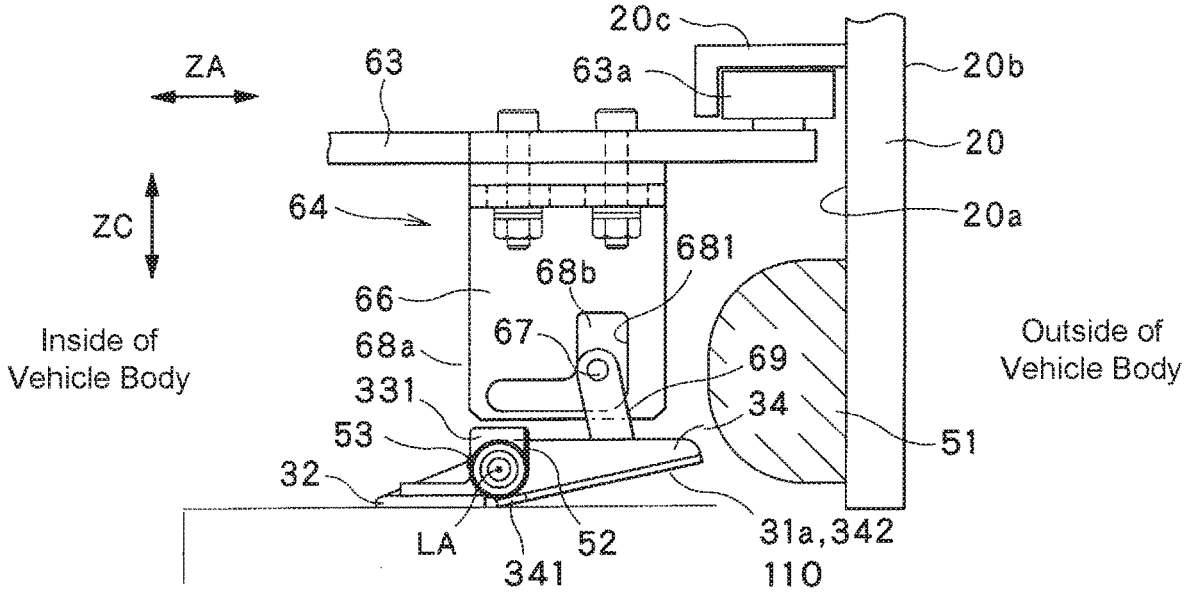
FIG. 6B is a side view showing the movable receiving portion being between the first receiving portion position and the second receiving portion position.

As shown in FIG. 6A to FIG. 6B, the roller 63*a* is provided at the end portion of the lower slide member 63, which is opposed to the door 20. The roller 63*a* is disposed within the roller rail 20*c* provided on the door 20 along the front-rear direction ZB. The roller rail 20*c* has a wall portion opposed to the door 20, and the roller 63*a* is disposed between said wall portion and the door 20. Furthermore, when the door 20 moves in the front-rear direction ZB, the roller 63*a* rotates as the door 20 moves. Shaking of the door 20 is restricted by the roller rail 20*c* and the roller 63*a* described above, and thus it is possible to cause the door 20 to stably move in the vehicle width direction ZA and in the front-rear direction ZB.

The front-rear operation portion 47 shown in FIG. 1 has a pair of pulleys 47*a* provided on the bottom surface of the upper slide member 43 so as to be spaced apart from each other in the front-rear direction ZB, a belt 47*b* wound around the pair of pulleys 47*a*, and a door coupling member 47*c* coupling the belt 47*b* to the door 20. The belt 47*b* is caused to rotate around the pair of pulleys 47*a* by the door driver 44. Rotation of the belt 47*b* causes the door coupling member 47*c* to move in the front-rear direction ZB, thus causing the door 20 to move in the front-rear direction ZB.

The opening frame 30 has a circumferential door receiving plate portion 31 directly opposed to the door 20 being at the first door position shown in FIG. 2A and a support portion 32 connected to the door receiving plate portion 31. In the example shown in FIG. 4A, the support portion 32 extends circumferentially. The support portion 32 is formed generally as a plate-shaped member extending in the vehicle width direction ZA. In this example, the door receiving plate portion 31 is a plate-shaped member extending out in the front-rear direction ZB from an outer end of the support portion 32 in the width direction ZA. Particularly, in the example shown, the door receiving plate portion 31 extends circumferentially along the circumferential support portion 32 and extends out inwardly from the circumferential support portion 32. Consequently, in a state shown in FIG. 4A, an outer edge of the opening 130 defined by the circumferential opening frame 30 is defined by the circumferential door receiving plate portion 31.

Figure 4A:
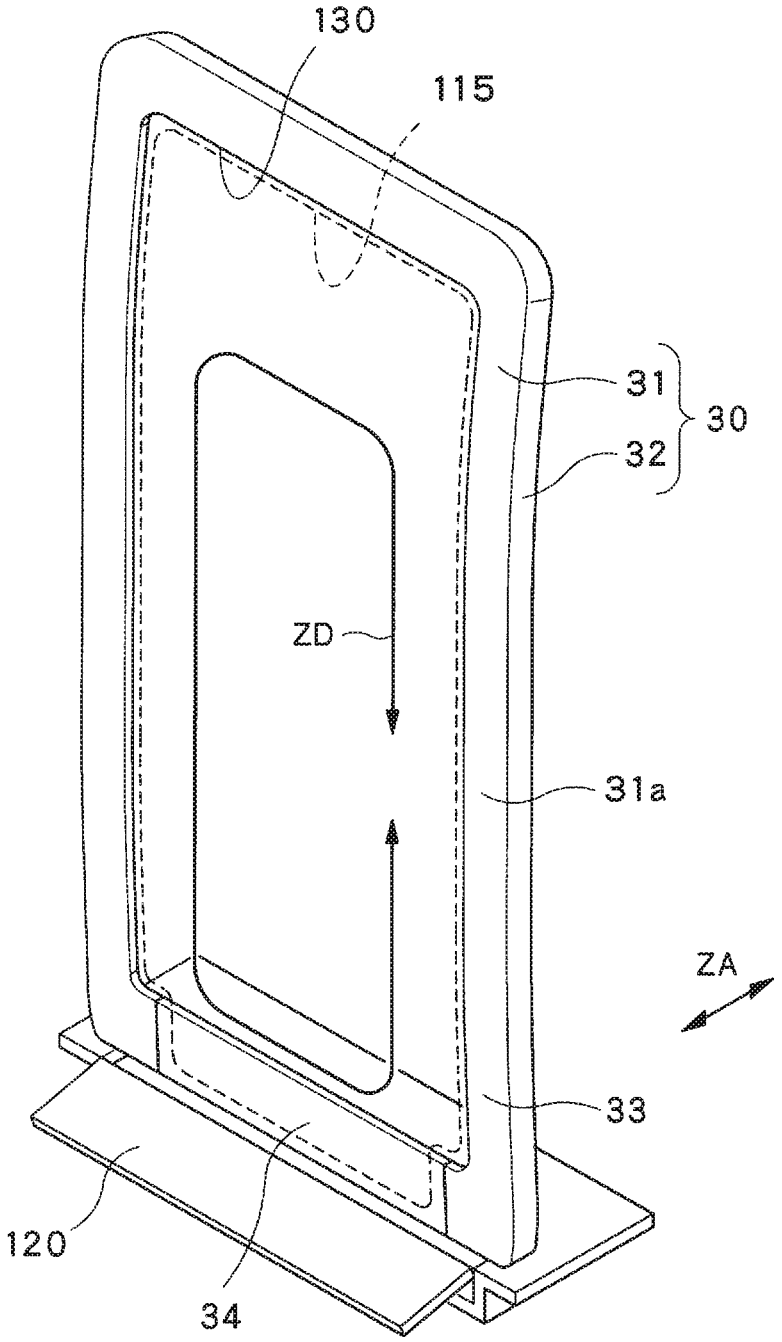
FIG. 4A is a perspective view showing an opening frame in a case where a movable receiving portion is at a first receiving portion position.
Figure 4B:
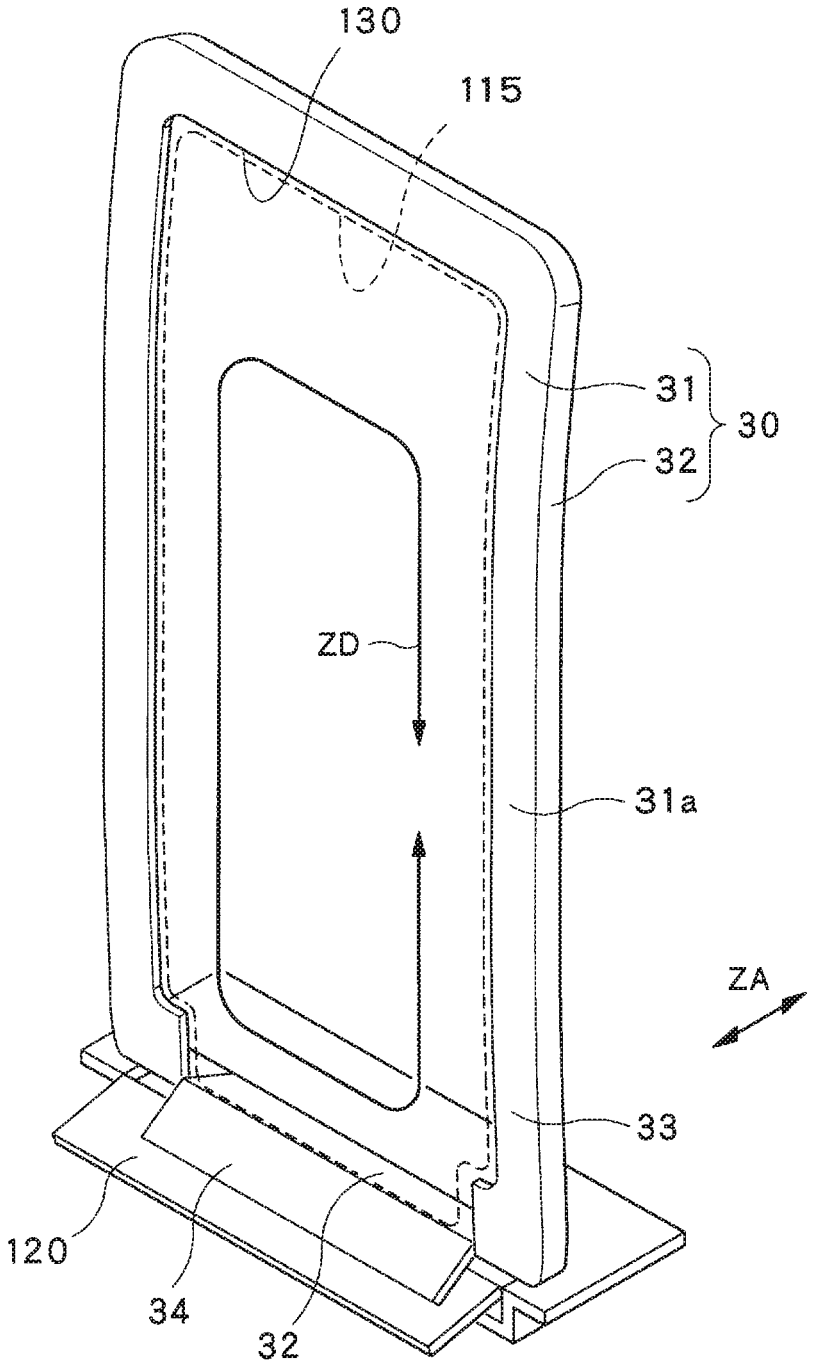
FIG. 4B is a perspective view showing the opening frame in a case where the movable receiving portion is at a second receiving portion position.

As shown in FIG. 4A and FIG. 4B, the door receiving plate portion 31 forms a receiving surface 31*a*. In a case where the door 20 is at the first door position shown in FIG. 2A, the receiving surface 31*a* makes contact with the seal member 51 provided circumferentially on the door 20. The receiving surface 31*a* faces outside in the vehicle width direction ZA. Furthermore, as shown in FIG. 4A and FIG. 4B, the door receiving plate portion 31 has a stationary receiving portion 33 that is maintained in a stationary state during a plug operation of the door 20 and the movable receiving portion 34 that is operable during a plug operation of the door 20.

In FIG. 4A and FIG. 4B, the doorway 115 is shown by a dotted line. Normally, the doorway 115 corresponds with the opening 130 defined by the opening frame 30 shown in FIG. 4A. However, in a case where the doorway 115 is desired to be widened, part of a portion constituting the receiving surface 31*a* may undesirably lie in a space expected to be used as the doorway 115 thus widened. In the example shown by way of illustration, preferably, the boarding/alighting assisting step board 120 is set to be equal in level to a floor surface of the vehicle body 110. In this case, it becomes necessary that a portion of the door receiving plate portion 31, which is positioned on a lower side, be set to lie within the doorway 115. The movable receiving portion 34 is particularly useful in such a case. As shown in FIG. 4B, in a case where the door 20 is at the second door position shown in FIG. 2B, the movable receiving portion 34 operates, thus making it possible to widen the opening 130 so that the opening 130 corresponds with the doorway 115, in other words, to avoid a situation where the door receiving plate portion 31 defining the opening 130 stands within the doorway 115. On the other hand, as shown in FIG. 4A, in a case where the door 20 is at the first door position shown in FIG. 2A, the movable receiving portion 34 stands within the space expected to be used as the doorway 115 closed by the door 20, forming part of the circumferential receiving surface 31*a*. Thus, it is possible to achieve effective airtightness between the door 20 and the vehicle body 110.

A portion of the opening frame 30 other than the movable receiving portion 34 is hidden in structures such as a wall and a ceiling of the vehicle body 110 and thus is concealed from passengers (people passing therethrough). That is, in the example shown, the opening frame 30 is configured as a four-way frame including an upper portion, a lower portion, and a pair of side portions. Only the lower portion is operable between a position at which the lower portion lies within the space expected to be used as the doorway 115 and a position at which the lower portion is separated from the space expected to be used as the doorway 115.

Figure 5:
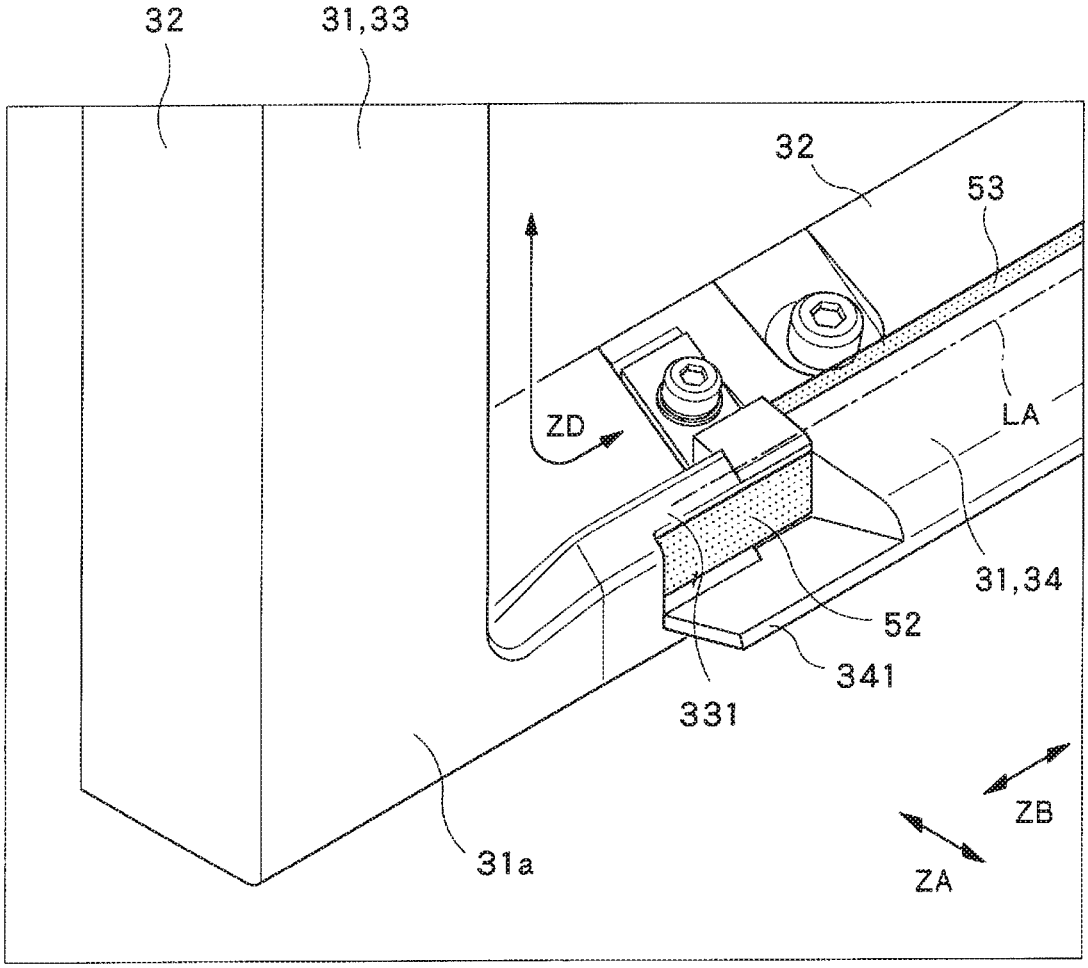
FIG. 5 is an enlarged perspective view showing a connection portion between a stationary portion and the movable receiving portion of the opening frame.
Figure 6C:
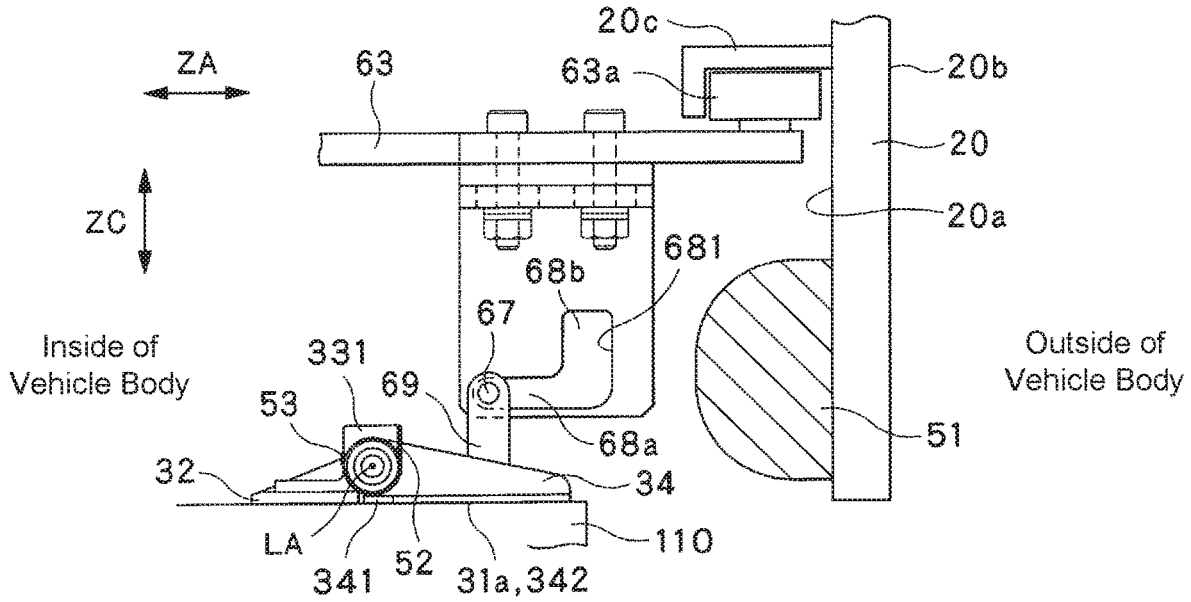
FIG. 6C is a side view showing the movable receiving portion being at the second receiving portion position.

As shown in FIG. 6A to FIG. 6C, the movable receiving portion 34 is rotatable about an axis LA (in the example shown in FIG. 1 to FIG. 6C, the axis LA along an extending direction (a circumferential direction) ZD of the opening frame 30) non-parallel to the moving direction ZA of the door 20 at the time of a plug operation. The movable receiving portion 34 can operate between a first receiving portion position (see FIG. 6A) at which the movable receiving portion 34 stands from the support portion 32 and a second receiving portion position at which the movable receiving portion 34 is lowered (see FIG. 6C). As is understood also from FIG. 6A and FIG. 6C, in a case where the movable receiving portion 34 is at the second receiving portion position, the opening 130 defined by the circumferential opening frame 30 becomes wider than in a case where the movable receiving portion 34 is at the first receiving portion position.

The movable receiving portion 34 shown in FIG. 1 operates between the first receiving portion position and the second receiving portion position in accordance with an operation (a plug operation) of the door 20 between the first door position and the second door position. Specifically, during a plug operation of the door 20, an operation of the plug operation portion 45 is transmitted to the movable receiving portion 34, so that in a case where the door 20 is at the first door position, the movable receiving portion 34 is positioned at the first receiving portion position shown in FIG. 6A, and in a case where the door 20 is at the second door position, the movable receiving portion 34 is at the second receiving portion position shown in FIG. 6C. An operation of the plug operation portion 45 is transmitted by a transmission unit 64 provided between the plug operation portion 45 and the movable receiving portion 34 of the opening frame 30. The transmission unit 64 may be provided between the door 20 and the movable receiving portion 34 so as to transmit an operation of the door 20 to the movable receiving portion 34.

FIG. 5 is an enlarged perspective view showing a connection portion between the stationary receiving portion 33 and the movable receiving portion 34 of the opening frame 30. As shown in FIG. 5, an end portion 331 of the stationary receiving portion 33 and an end portion 341 of the movable receiving portion 34 extend along the circumferential direction ZD of the opening frame 30 and are positioned so as to overlap each other in a partial region along the circumferential direction ZD. As shown in FIG. 6A, in a case where the movable receiving portion 34 is at the first receiving portion position, the end portion 331 of the stationary receiving portion 33 and the end portion 341 of the movable receiving portion 34 are directly opposed to each other in the moving direction ZA of the door 20 at the time of a plug operation. A seal member 52 is provided at the end portion 331 of the stationary receiving portion 33 so that the end portion 341 of the movable receiving portion 34 being at the first receiving portion position and the end portion 331 of the stationary receiving portion 33 are tightly attached to each other along the circumferential direction ZD of the opening frame 30. Furthermore, in a region of the support portion 32, which is directly opposed to the movable receiving portion 34 being at the first receiving portion position, a seal member 53 is provided along said circumferential direction ZD so that the movable receiving portion 34 being at the first receiving portion position and the support portion 32 are tightly attached to each other along said circumferential direction ZD. This configuration makes it possible to achieve effective airtightness between the stationary receiving portion 33 and the movable receiving portion 34 of the opening frame 30 and thus to achieve effective airtightness between the opening frame 30 and the door 20 in a case where the door 20 is at the first door position shown in FIG. 2A.

Next, with reference to FIG. 6A to FIG. 6C, the following describes in detail the transmission unit 64 according to this embodiment. As shown in FIG. 6A to FIG. 6C, the transmission unit 64 is provided between the lower slide member 63 of the plug operation portion 45 and an end portion of the movable receiving portion 34.

As shown in FIG. 6A to FIG. 6C, the transmission unit 64 has a plate 66 fixed to the lower slide member 63 and a pin 67 fixed to one end portion of the movable receiving portion 34 and engaged with the plate 66. The plate 66 has an L-shaped opening 68 provided therein. The L-shaped opening 68 has a width direction opening region 68*a* extending along the vehicle width direction ZA and a height direction opening region 68*b* extending in the height direction ZC. The height direction opening region 68*b* extends upward from an end portion of the width direction opening region 68*a* near the door 20. A width W of the height direction opening region 68*b* is larger than a diameter R of the after-mentioned pin 67 and is, preferably, twice to three times larger than the diameter R.

The pin 67 is provided on a pin base 69 protruding from the one end portion of the movable receiving portion 34 and protrudes from the pin base 69 toward the plate 66. Positioning of the plate 66 and the pin 67 is set so that when the movable receiving portion 34 is at the first receiving portion position shown in FIG. 6A, the pin 67 is positioned within the height direction opening region 68*b* of the plate 66, and when the movable receiving portion 34 is at the second receiving portion position shown in FIG. 6C, the pin 67 is positioned within the width direction opening region 68*a*.

Next, a description is given of an effect of the door device according to the first embodiment.

First, in a case where the door 20 is at the first door position as shown in FIG. 2A, the movable receiving portion 34 of the opening frame 30 is at the first receiving portion position at which the movable receiving portion 34 stands from the support portion 32 of the opening frame 30 as shown in FIG. 6A. At this time, a surface 342 of the movable receiving portion 34, which is directly opposed to the door 20, becomes flush with the receiving surface 31*a* of the stationary receiving portion 33 of the opening frame 30. Consequently, the receiving surface 31*a* of the opening frame 30 becomes circumferential.

In a case where the door 20 is at the first door position as shown in FIG. 2A and FIG. 6A, the receiving surface 31*a*, which has become circumferential as mentioned above, and the door 20 are tightly attached to each other via the seal member 51 provided circumferentially on the door 20. Furthermore, in the opening frame 30, the end portion 331 of the stationary receiving portion 33 along the circumferential direction ZD and the end portion 341 of the movable receiving portion 34 along said circumferential direction ZD are directly opposed to each other in the moving direction ZA of the door 20 at the time of a plug operation. Therefore, the end portion 331 of the stationary receiving portion 33 and the end portion 341 of the movable receiving portion 34 are tightly attached to each other via the seal member 52. Furthermore, the movable receiving portion 34 is tightly attached to the support portion 32 via the seal member 53 of the opening frame 30. In this manner, the vehicle body 110 has been made airtight.

In a case where the door 20 being at the first door position shown in FIG. 2A is opened, the plug operation portion 45 is driven by the door driver 44 so that the upper slide member 43 slides in the vehicle width direction ZA along the rails 42 toward outside of the vehicle body 110. In accordance therewith, the door 20 suspended from between the upper slide member 43 and the fixed base 41 moves in the vehicle width direction ZA toward the second door position shown in FIG. 2B.

At this time, in tandem with an operation of the upper slide member 43, the lower slide member 63 also slides toward outside of the vehicle body 110. Specifically, when the upper slide member 43 slides in the vehicle width direction ZA to outside of the vehicle body 110, the first rack 62 of the transmission unit 64, which is provided on the side surface of the upper slide member 43, also moves together with the upper slide member 43. In accordance with movement of the first rack 62, the first pinion 61*a* provided at the one end portion of the shaft 61 rotates, so that the shaft 61 and the second pinion 61*b* provided at the other end of the shaft 61 also rotate.

When the second pinion 61*b* rotates, rotation of the second pinion 61*b* is transmitted to the second rack 65, and thus the lower slide member 63 slides in the vehicle width direction ZA toward outside of the vehicle body 110.

In tandem with an operation of the lower slide member 63, the transmission unit 64 operates the movable receiving portion 34. Specifically, in accordance with movement of the lower slide member 73, the plate 66 fixed to the lower slide member 63 moves toward outside of the vehicle body 110. In this case, however, since the width W of the height direction opening region 68*b* is larger than the diameter of the pin 67, the pin 67 does not make contact with the plate 66 from right after the plate 66 has started to move to a time when the plate 66 has moved a given distance. Consequently, for a given period of time after a start of a plug operation of the door 20, the movable receiving portion 34 is retained at the first receiving portion position at which the movable receiving portion 34 stands from the support portion 32. As shown in FIG. 6B, when the plate 66 moves to a predetermined position, the pin 67 being positioned within the height direction opening region 68*b* of the L-shaped opening 68 of the plate 66 makes contact with and moves along an edge portion 681 of the opening 68 into the width direction opening region 68*a*. Upon this movement of the pin 67, the movable receiving portion 34 rotates about the axis LA so as to operate toward the second receiving portion position at which the movable receiving portion 34 is lowered. In this manner, in a case where the door 20 being at the first door position is opened, the movable receiving portion 34 constituting part of the opening frame 30 operates so as to widen the opening 130 defined by the opening frame 30. As a result, as is understood from FIG. 6A and FIG. 6C, in a case where the movable receiving portion 34 is at the second receiving portion position shown in FIG. 4B and FIG. 6C, the opening 130 defined by the circumferential opening frame 30 becomes wider than in a case where the movable receiving portion 34 is at the first receiving portion position shown in FIG. 4A and FIG. 6A. The stationary receiving portion 33 of the opening frame 30 is maintained in a stationary state also during a plug operation of the door 20.

Herein, the movable receiving portion 34 shown in FIG. 6A to FIG. 6C ends an operation before the door 20 reaches the second door position. Consequently, even after the movable receiving portion 34 has ended movement to the second receiving portion position at which the movable receiving portion 34 is lowered, the plate 66 moves in accordance with movement of the door 20 to the second door position. At this time, since the pin 67 is disposed within the width direction opening region 68*a* of the opening 68, movement of the plate 66 is not obstructed.

After the door 20 has moved to the second door position, the front-rear operation portion 47 is driven by the door driver 44, and thus the door 20 moves in the front-rear direction ZB with respect to the opening frame 30. Thus, the doorway (the boarding/alighting port) 115 is exposed. At this time, the movable receiving portion 34 has been lowered onto the floor surface and thus does not stand and lie in the space expected to be used as the doorway 115. Consequently, the opening 130 can be increased in wideness, and it is also possible to effectively avoid a situation where the door receiving plate portion 31 protrudes therein and interferes with passage therethrough.

On the other hand, in a case where the door 20 being at the second door position shown in FIG. 2B is closed, the upper plug operation portion 46 is driven by the door driver 44 so that the upper slide member 43 slides in the vehicle width direction ZA along the rails 42 toward inside of the vehicle body 110. In accordance therewith, the door 20 suspended from between the upper slide member 43 and the fixed base 41 moves in the vehicle width direction ZA toward the first door position shown in FIG. 2A.

When the upper slide member 43 slides in the vehicle width direction ZA, the first rack 62 of the lower plug operation portion 60, which is provided on the side surface of the upper slide member 43, also moves together with the upper slide member 43. In accordance with movement of the first rack 62, the first pinion 61*a* provided at the one end portion of the shaft 61 rotates, so that the shaft 61 and the second pinion 61*b* provided at the other end of the shaft 61 also rotate.

When the second pinion 61*b* rotates, rotation of the second pinion 61*b* is transmitted to the second rack 65, and thus the lower slide member 63 slides in the vehicle width direction ZA toward inside of the vehicle body 110.

As shown in FIG. 6C and FIG. 6B, in accordance with movement of the lower slide member 63, the plate 66 fixed to the lower slide member 63 moves toward inside of the vehicle body 110. When the plate 66 moves to a predetermined position, as shown in FIG. 6B, the pin 67 being positioned within the width direction opening region 68*a* of the opening 68 of the plate 66 makes contact with and moves along the edge portion 681 of the opening 68, which extends in the height direction ZC, into the height direction opening region 68*b*. Upon this movement of the pin 67, the movable receiving portion 34 in a lowered state rotates about the axis LA so as to operate toward the first receiving portion position at which the movable receiving portion 34 stands. In this manner, in a case where the door 20 being at the second door position is closed, the movable receiving portion 34 constituting part of the opening frame 30 operates so as to narrow the opening 13 defined by the opening frame 30. At this time, in the opening frame 30, the end portion 331 of the stationary receiving portion 33 and the end portion 341 of the movable receiving portion 34 are directly opposed to each other in the moving direction ZA of the door 20 at the time of a plug operation.

When the movable receiving portion 34 moves to the first receiving portion position shown in FIG. 6A, the surface 342 of the movable receiving portion 34, which is directly opposed to the door 20, becomes flush with the receiving surface 31*a* of the stationary receiving portion 33 of the opening frame 30. Consequently, the receiving surface 31*a* of the opening frame 30 becomes circumferential (see FIG. 4A). As shown in FIG. 6A, when the door 20 moves to the first door position, the receiving surface 31*a* of the opening frame 30, which has become circumferential, and the door 20 are tightly attached to each other via the seal member 51 provided circumferentially on the door 20. Furthermore, in the opening frame 30, the end portion 331 of the stationary receiving portion 33 and the end portion 341 of the movable receiving portion 34, which is directly opposed to said end portion 331, are tightly attached to each other via the seal member 52. Furthermore, the support portion 32 and a region of the movable receiving portion 34 along the circumferential direction ZD of the opening frame 30 are tightly attached to each other via the seal member 53. In this manner, the vehicle body 110 is made airtight.

The door device 10 according to this embodiment is provided with the opening frame 30 defining the opening 130 and the door 20 that operates between the first door position at which the door 20 makes contact with the opening frame 30 and the second door position at which the door 20 is separated from the opening frame 30. The movable receiving portion 34 constituted by at least part of the opening frame 30 operates so that the opening 130 is larger when the door 20 is at the second door position than when the door 20 is at the first door position.

According to the door device 10 described above, the opening frame 30 defining the opening 130 can be operated so that the opening 130 is widened when the door 20 is opened. Therefore, when the door 20 is closed, airtightness of the vehicle body 110 can be obtained by providing, at a peripheral portion of the opening 130, a region that makes contact with the door 20. On the other hand, when the door 20 is opened, passage of a human or movement of an object through the opening 130 can be facilitated by widening the opening 130.

It can be said that this working effect is useful not only for a door device used for a vehicle but also for a door device applied to various uses.

Furthermore, in this embodiment, an operation of widening the opening 130 of the opening frame 30 is performed in accordance with an operation of opening the door 20, and thus at the time of opening the door 20, it is possible to widen the opening 130 without performing an additional operation for operating the opening frame 30.

Furthermore, in the door device 10 according to this embodiment, when the door 20 being at the second door position moves to the first door position, the movable receiving portion 34 operates so as to narrow the opening 130. As a result, at the time of closing the door 20, it is possible to narrow the opening 130, which has been widened upon opening of the door 20, without performing an additional operation for operating the opening frame 30.

Furthermore, in the door device 10 according to this embodiment, the movable receiving portion 34 operates in accordance with an operation of the door 20 between the first door position and the second door position. As a result, at the time of opening and closing the door 20, it is possible to widen and narrow the opening 130, respectively, without performing an additional operation for operating the opening frame 30.

Specifically, the door device 10 according to this embodiment is provided further with the plug operation portion 45 that operates the door 20 between the first door position and the second door position, and the transmission unit 64 that is provided between either the plug operation portion 45 or the door 20 and the movable receiving portion 34 of the opening frame 30 and transmits an operation of either the plug operation 45 or the door 20 to the movable receiving portion 34. As a result, the movable receiving portion 34 can be operated in accordance with a plug operation of the door 20.

Furthermore, in the door device 10 according to this embodiment, when the door 20 moves from the first door position to the second door position, the movable receiving portion 34 of the opening frame 30 starts an operation after the door 20 has started an operation from the first door position and moved a given distance. As a result, it is possible to effectively avoid a situation where the movable receiving portion 34 collides with the door 20.

Furthermore, in the door device 10 according to this embodiment, when the door 20 moves from the first door position to the second door position, the movable receiving portion 34 of the opening frame 30 ends an operation before the door 20 reaches the second door position. As a result, when the door 20 is caused to move in the front-rear direction from the second door position, thus exposing the opening 130, there is prevented a phenomenon in which an operation of the movable receiving portion 34 has not ended yet, so that passage of a human or movement of an object through the opening 130 is obstructed.

Furthermore, in the door device 10 according to this embodiment, the movable receiving portion 34 is rotatable about the axis LA non-parallel to the moving direction ZA of the door 20 between the first door position and the second door position. Specifically, the movable receiving portion 34 is rotatable about the axis LA along the extending direction ZD of the opening frame 30. Thus, the movable receiving portion 34 is easily operated so as to widen the opening 130 defined by the opening frame 30.

Furthermore, in the door device 10 according to this embodiment, the opening frame 30 has the circumferential door receiving plate portion 31 forming the circumferential receiving surface 31*a* coming in contact with the door 20 being at the first door position, and the support portion 32 connected to the door receiving plate portion 31, and the movable receiving portion 34 constitutes part of the door receiving plate portion 31 and is operable between the first receiving portion position at which the movable receiving portion 34 stands from the support portion 32 and the second receiving portion position at which the movable receiving portion 34 is lowered. According to the door device 10 described above, using a simple configuration and a simple operation, it is possible to achieve a state where the circumferential receiving surface 31*a* is formed and a state where the opening 140 is widened.

Furthermore, in the door device 10 according to this embodiment, the door receiving plate portion 31 further has the stationary receiving portion 33 maintained in a stationary state while the door 20 operates between the first door position and the second door position, and when the door 20 is at the first door position, the end portion 331 of the stationary receiving portion 33 along the extending direction ZD of the opening frame 30 and the end portion 341 of the movable receiving portion 34 along the extending direction ZD are directly opposed to each other in the moving direction ZA of the door 20 when operating between the first door position and the second door position. Therefore, airtightness is easily obtained between the end portion 331 of the stationary receiving portion 33 and the end portion 341 of the movable receiving portion 34. Specifically, in the door device 10 according to this embodiment, the seal member 52 is provided between the end portion 331 of the stationary receiving portion 33 and the end portion 341 of the movable receiving portion 34.

Furthermore, in the door device 10 according to this embodiment, the movable receiving portion 34 being at the first receiving portion position is tightly attached to the support portion 32 in a region along the extending direction ZD of the opening frame 30. Thus, airtightness can be obtained between the movable receiving portion 34 and the support portion 32.

Furthermore, the door device 10 according to this embodiment is used for the vehicle 100. According to the door device 10 described above, while the vehicle 100 travels, the opening 130 is narrowed and the door 20 is brought in contact with the opening frame 30, so that airtightness of the vehicle body 110 can be obtained. On the other hand, when the vehicle 100 stops and the door 20 is opened, passage of a human or movement of an object through the opening 130 can be facilitated by widening the opening 130.

The vehicle 100 according to this embodiment is provided with the vehicle body 110 and the above-mentioned door device 10 installed in the vehicle body 110. According to the vehicle 100 described above, while the vehicle 100 travels, the opening 130 is narrowed and the door 20 is brought in contact with the opening frame 30, so that airtightness of the vehicle body 110 can be obtained. On the other hand, when the vehicle 100 stops and the door 20 is opened, passage of a human or movement of an object through the opening 130 can be facilitated by widening the opening 130.

Various modifications can be made to the foregoing embodiment. While referring to the appended drawings, the following describes several modification examples. In the following description and the drawings used therein, parts that can be configured in a similar manner to that in the foregoing embodiment are denoted by the same reference characters as those used for corresponding parts in the foregoing embodiment, and duplicate descriptions thereof are omitted. Furthermore, when it is obvious that the working effects obtained in the foregoing embodiment can be obtained also in the modification examples, a description thereof is possibly omitted.

Figure 7A:
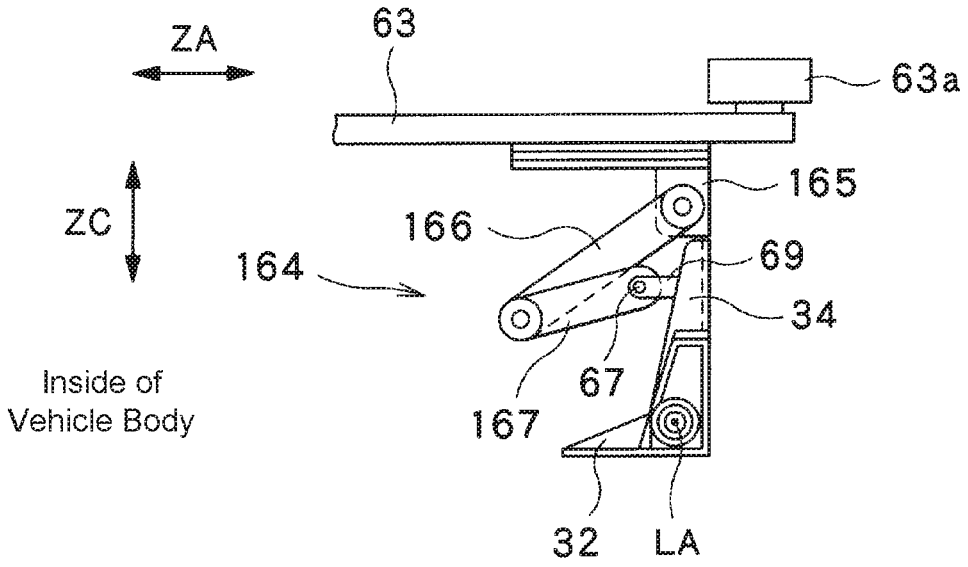
FIG. 7A illustrates a first modification example of the door device, showing a side view of a movable receiving portion being at a first receiving portion position.
Figure 7B:
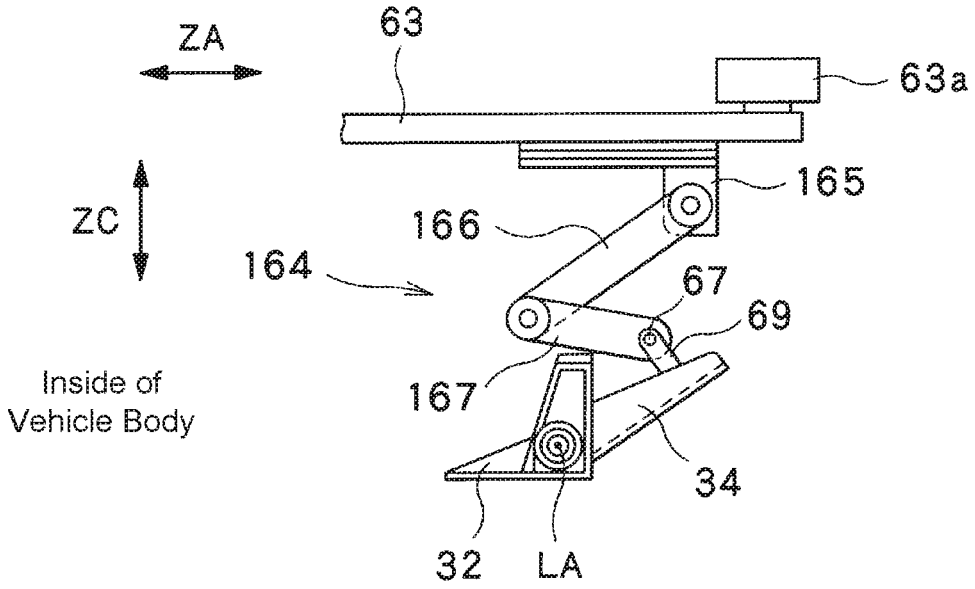
FIG. 7B is a side view showing the movable receiving portion being between the first receiving portion position and a second receiving portion position.
Figure 7C:
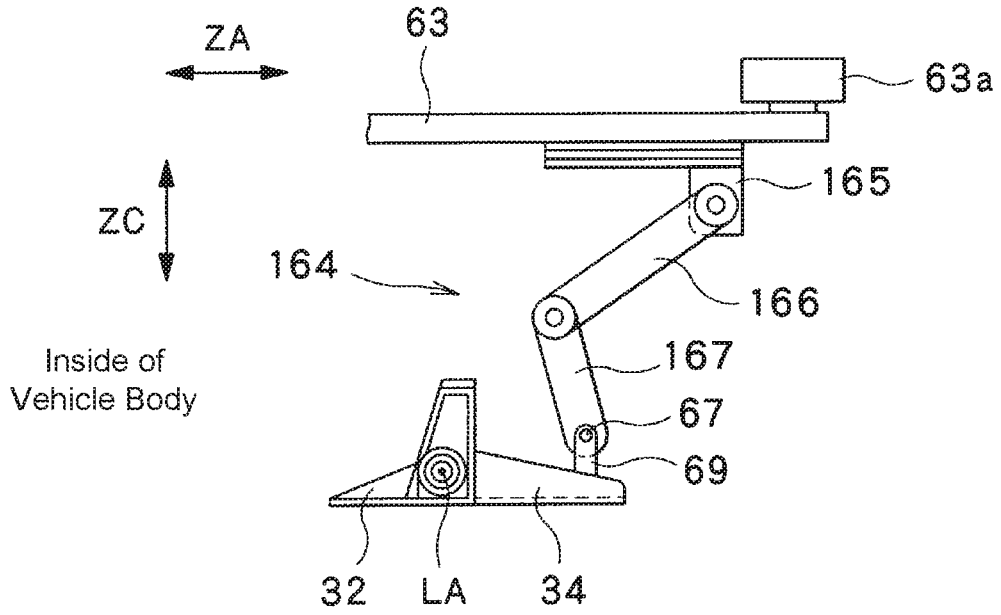
FIG. 7C is a side view showing the movable receiving portion being at the second receiving portion position.

With reference to FIG. 7A to FIG. 7C, a description is given of a first modification example of the door device according to the present invention. In the first modification example shown in FIG. 7A to FIG. 7C, a transmission unit is configured differently, and other configurations are substantially the same as those in the embodiment shown in FIG. 1 to FIG. 6C.

A transmission unit 164 according to the first modification example has a base 165 fixed to the lower slide member 63, a pin 67 fixed to one end portion of the movable receiving portion 34, and a first link plate 166 and a second link plate 167 disposed between the base 165 and the movable receiving portion 34. The first link plate 166 is fixed at one end portion thereof to the base 165. The first link plate 166 extends so that the other end portion thereof is positioned more inside of the vehicle body 110 than the one end portion thereof. Furthermore, the first link plate 166 is rotatably connected at the other end portion thereof to one end portion of the second link plate 167. The pin 67 of the movable receiving portion 34 is rotatably connected to the other end portion of the second link plate 167.

Next, a description is given of an effect of the door device according to the first modification example.

First, as shown in FIG. 7A, in a case where the door 20 is at the first door position and the movable receiving portion 34 of the opening frame 30 is at the first receiving portion position at which the movable receiving portion 34 stands, the base 165 of the transmission unit 164 and the pin 67 provided at the movable receiving portion 34 are in proximity to each other. Therefore, the one end portion of the first link plate 166 and the other end portion of the second link plate 167 are in proximity to each other, and thus the first link plate 166 and the second link plate 167 are in a folded state.

In a case where the door 20 being at the first door position is opened, the plug operation portion 45 is driven to cause the lower slide member 63 to slide toward outside of the vehicle body 110. As shown in FIG. 7B, in accordance with movement of the lower slide member 63, the base 165 moves toward outside of the vehicle body 110. When the base 165 moves toward outside of the vehicle body 110, the movable receiving portion 34 rotates in a direction toward the second receiving portion position shown in FIG. 7C. At this time, the first link plate 166 and the second link plate 167 rotate relative to each other, so that the one end portion of the first link plate 166 and the other end portion of the second link plate 167 are separated from each other. As shown in FIG. 7C, after the movable receiving portion 34 has moved to the second receiving portion position, the base 165 continues to move toward outside of the vehicle body 110 while further separating the one end portion of the first link plate 166 from the other end portion of the second link plate 167. The base 165 stops moving when the door 20 reaches the second door position.

On the other hand, in a case where the door 20 being at the second door position is closed, the plug operation portion 45 is driven to cause the lower slide member 63 to slide toward inside of the vehicle body 110. As shown in FIG. 7C and FIG. 7B, in accordance with movement of the lower slide member 63, the base 165 moves toward inside of the vehicle body 110. When the base 165 moves toward inside of the vehicle body 110, the movable receiving portion 34 rotates in a direction toward the first receiving portion position shown in FIG. 7A. At this time, the first link plate 166 and the second link plate 167 rotate relative to each other, so that they are folded while the one end portion of the first link plate 166 and the other end portion of the second link plate 167 are brought closer together.

A similar effect to that of the plug operation device according to the foregoing embodiment can be obtained also by the plug operation device according to the first modification example.

With reference to FIG. 8A to FIG. 8D, a description is given of a second modification example of the door device according to the present invention. In the second modification example shown in FIG. 8A to FIG. 8D, a transmission unit is configured differently, and other configurations are substantially the same as those in the embodiment shown in FIG. 1 to FIG. 6C.

A transmission unit 264 according to the second modification example has a base 265 fixed to the lower slide member 63, a pin 67 fixed to one end portion of the movable receiving portion 34, and a first link plate 266 and a second link plate 267 disposed between the base 265 and the movable receiving portion 34. A first pin 271 is provided at one end of the base 265. The first pin 271 protrudes substantially parallel to the front-rear direction ZB of the vehicle body 110. The first link plate 266 is rotatably supported at one end portion thereof by a second pin 272 projecting from the wall surface 111 of the vehicle body 110. The first link plate 266 can rotate in a plane substantially perpendicular to the front-rear direction ZB of the vehicle body 110. A cutout **266*a* is provided at the other end portion of the first link plate 266. The cutout 266*a* receives the first pin 271 provided at the base 265. While the base 265 moves, the first pin 271 is received by said cutout 266*a*, thus causing the first link plate 266** to rotate.

The second link plate 267 is fixed at one end portion thereof to the one end portion of the first link plate 266. The second link plate 267 can rotate together with the first link plate 266 about the second pin 272. The second link plate 267 has, at the other end portion thereof, an opening 268 extending along a longitudinal direction of the second link plate 267. The pin 67 of the movable receiving portion 34 is disposed within the opening 268, and the second link plate 267 and the pin 67 are rotatable relative to each other.

Next, a description is given of an effect of the door device according to the second modification example.

Figure 8A:
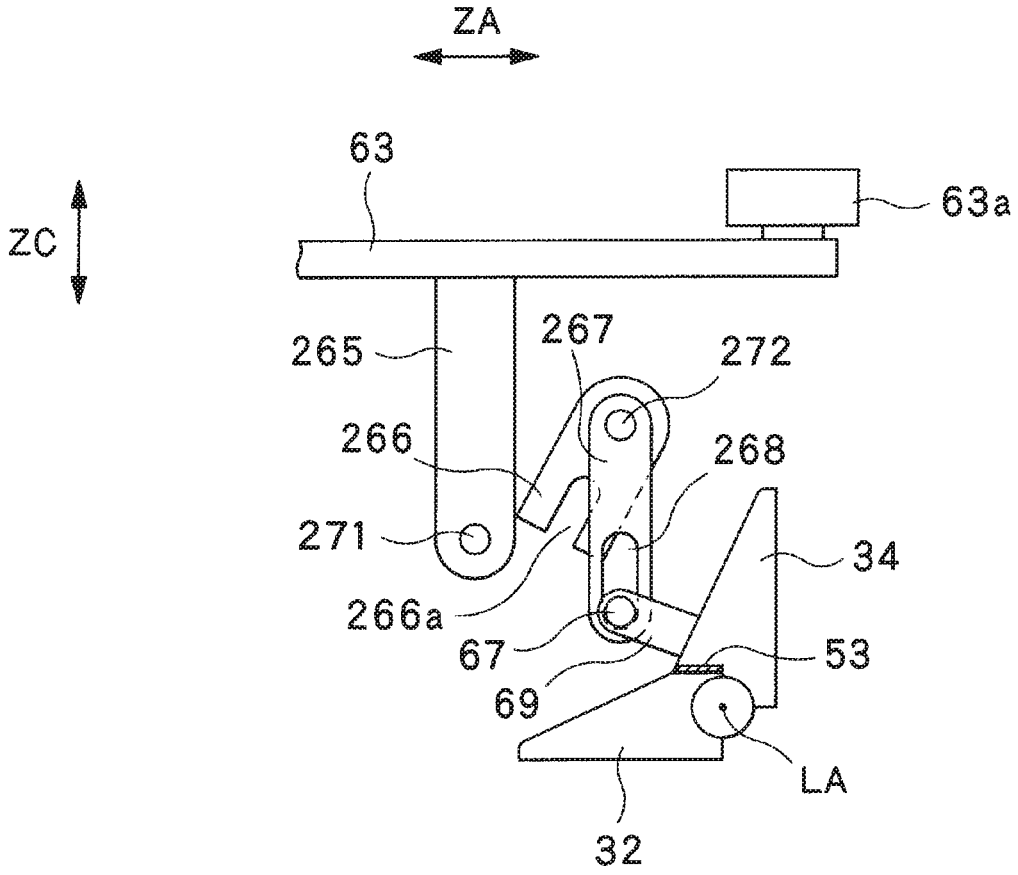
FIG. 8A illustrates a second modification example of the door device, showing a side view of a movable receiving portion being at a first receiving portion position.

First, as shown in FIG. 8A, in a case where the door 20 is at the first door position and the movable receiving portion 34 of the opening frame 30 is at the first receiving portion position at which the movable receiving portion 34 stands, the first pin 271 provided at the base 265 of the transmission unit 264 is positioned more inside of the vehicle body 110 than the other end portion of the first link plate 266.

Figure 8B:
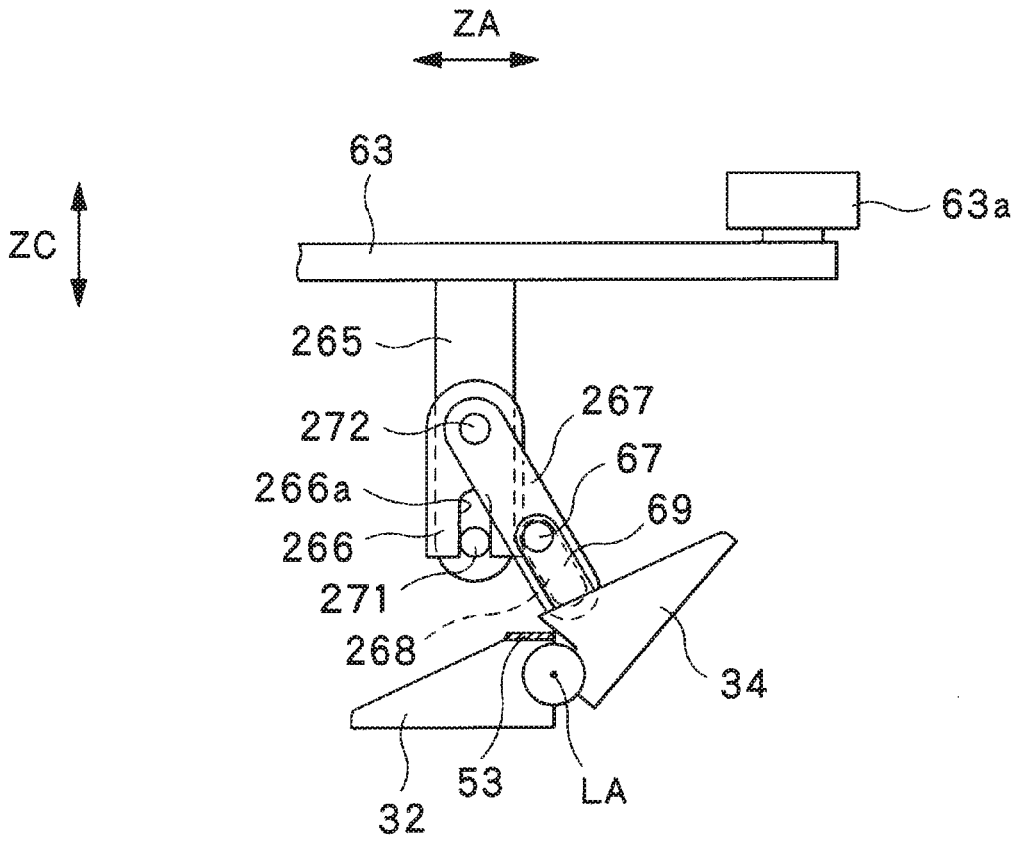
FIG. 8B is a side view showing the movable receiving portion being between the first receiving portion position and a second receiving portion position.
Figure 8C:
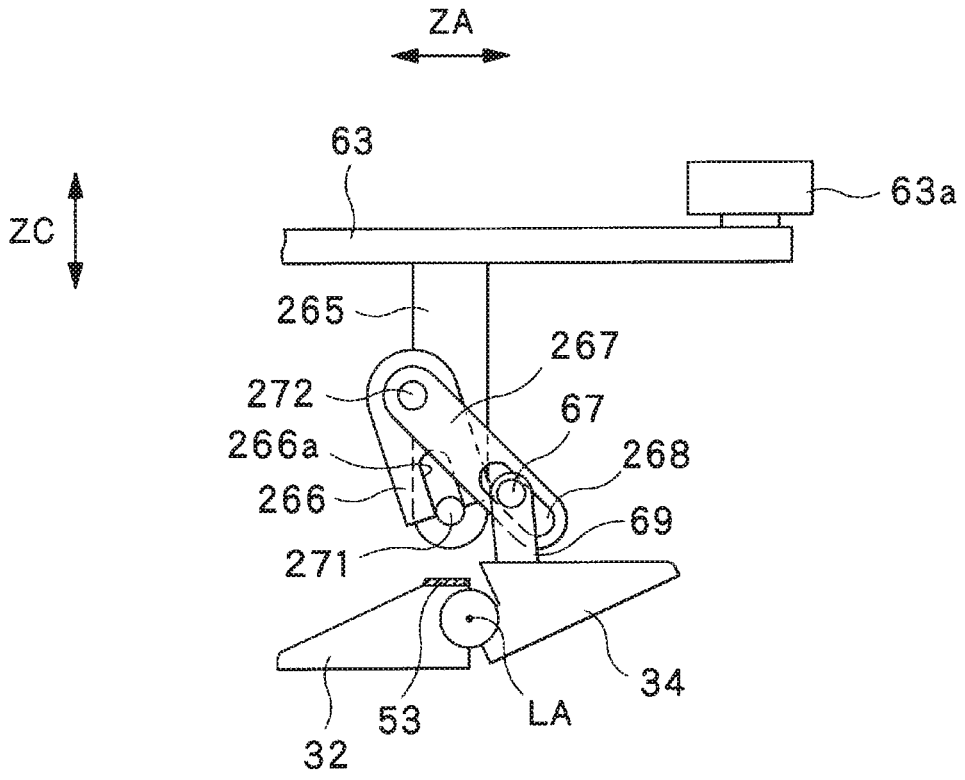
FIG. 8C is a side view showing the movable receiving portion being between a position shown in FIG. 8B and the second receiving portion position.
Figure 8D:
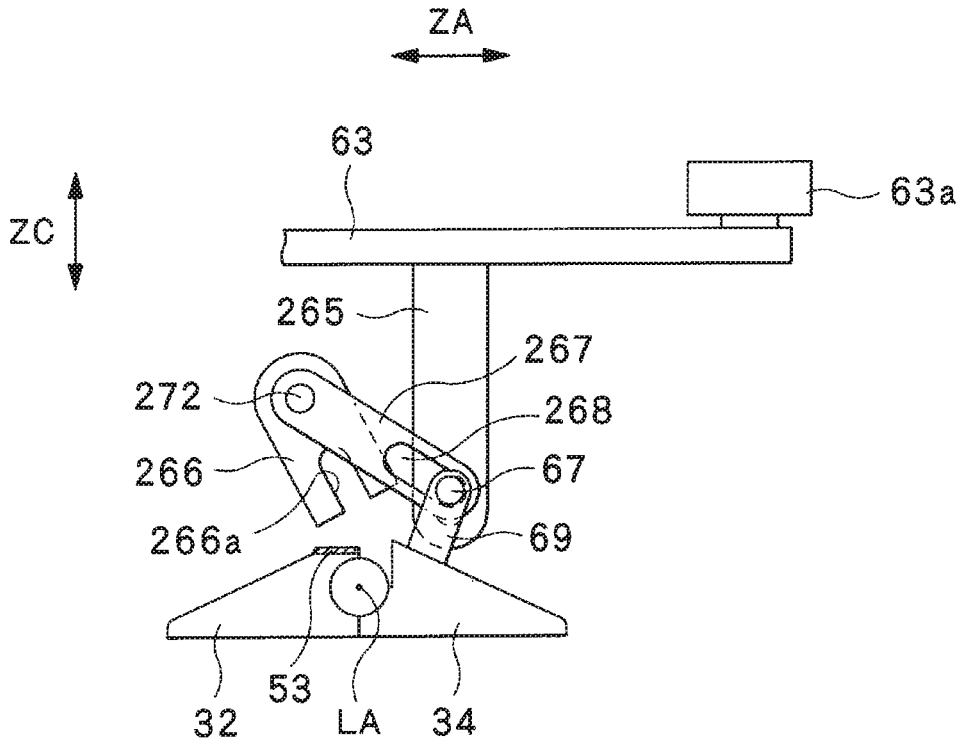
FIG. 8D is a side view showing the movable receiving portion being at the second receiving portion position.

As shown in FIG. 8B, in a case where the door 20 being at the first door position is opened, the plug operation portion 45 is driven to cause the lower slide member 63 to slide toward outside of the vehicle body 110. Thus, the base 265 moves toward outside of the vehicle body 110. As shown in FIG. 8B, when the base 265 moves to a predetermined position, the first pin 271 is received by the cutout **266*a* of the first link plate 266, thus causing the first link plate 266 and the second link plate 267 fixed to the first link plate 266 to rotate. As a result of rotation of the second link plate 267, the movable receiving portion 34 rotates in a direction toward the second receiving portion position shown in FIG. 8D. As shown in FIG. 8C and FIG. 8D, when the first pin 271 moves to a predetermined position, the first pin 271 is released from the cutout 266*a* of the first link plate 266. After that, the movable receiving portion 34 continues to rotate and thus moves to the second receiving portion position. The base 265 stops moving when the door 20** reaches the second door position.

On the other hand, in a case where the door 20 being at the second door position is closed, the plug operation portion 45 is driven to cause the lower slide member 63 to slide toward inside of the vehicle body 110. Thus, the base 265 moves toward inside of the vehicle body 110. As shown in FIG. 8D and FIG. 8C, when the base 265 moves to a predetermined position, the first pin 271 is received by the cutout **266*a* of the first link plate 266, thus causing the first link plate 266 and the second link plate 267 fixed to the first link plate 266 to rotate. As a result of rotation of the second link plate 267, the movable receiving portion 34 rotates in a direction toward the first receiving portion position shown in FIG. 8A. As shown in FIG. 8B and FIG. 8A, when the first pin 271 moves to a predetermined position, the first pin 271 is released from the cutout 266*a* of the first link plate 266. After that, the movable receiving portion 34 continues to rotate and thus moves to the first receiving portion position. The base 265 stops moving when the door 20** reaches the first door position.

A similar effect to that of the door device according to the foregoing embodiment can be obtained also by the door device according to the second modification example. Moreover, according to the plug operation device of the second modification example, in a case where the door 20 moves from the second door position to the first door position, the movable receiving portion 34 of the opening frame 30 ends an operation before the door 20 reaches the first door position. As a result, there is prevented a phenomenon in which movement of the door 20 to the first door position is obstructed by the movable receiving portion 34.

Figure 9A:
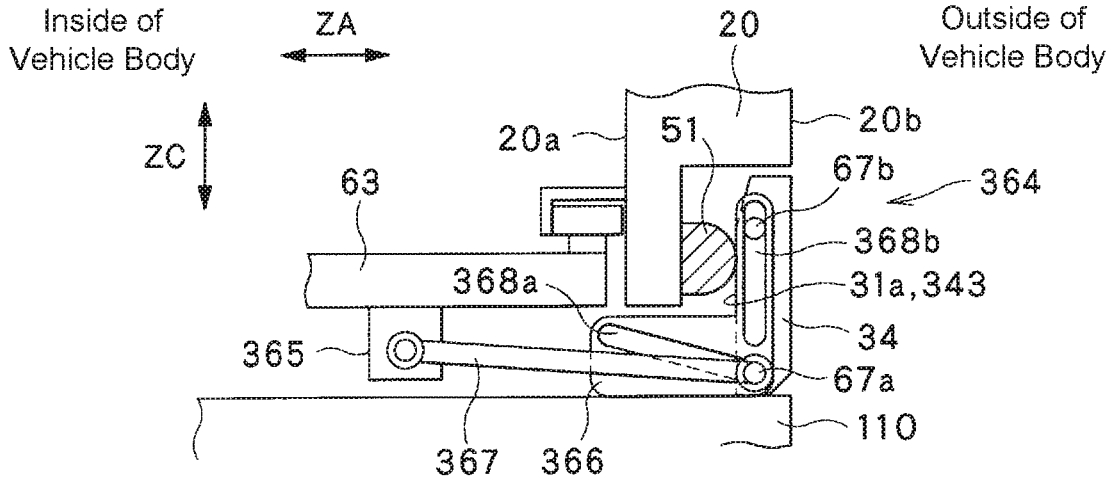
FIG. 9A illustrates a third modification example of the door device, showing a side view of a movable receiving portion being at a first receiving portion position.
Figure 9B:
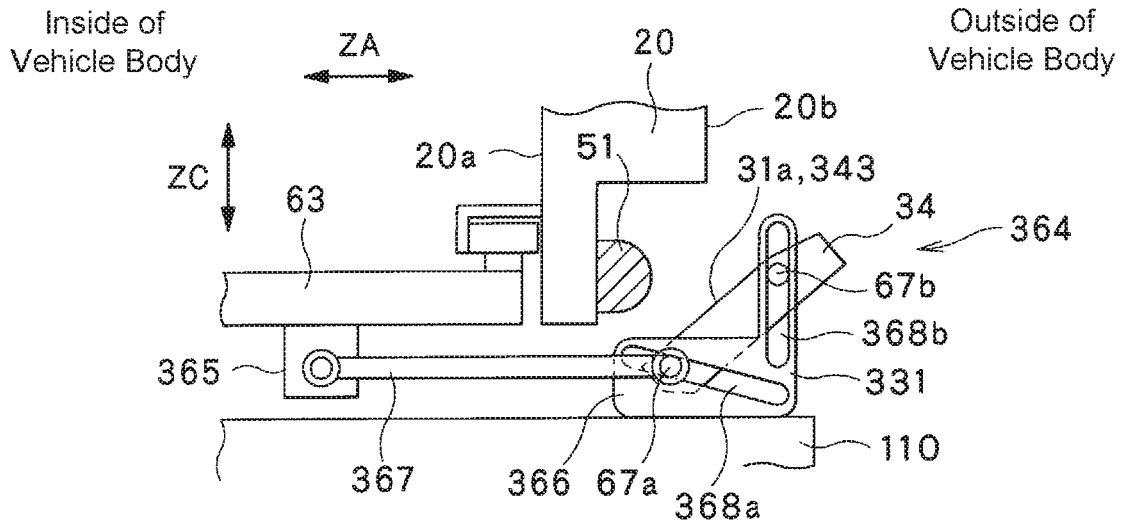
FIG. 9B is a side view showing the movable receiving portion being between the first receiving portion position and a second receiving portion position.
Figure 9C:
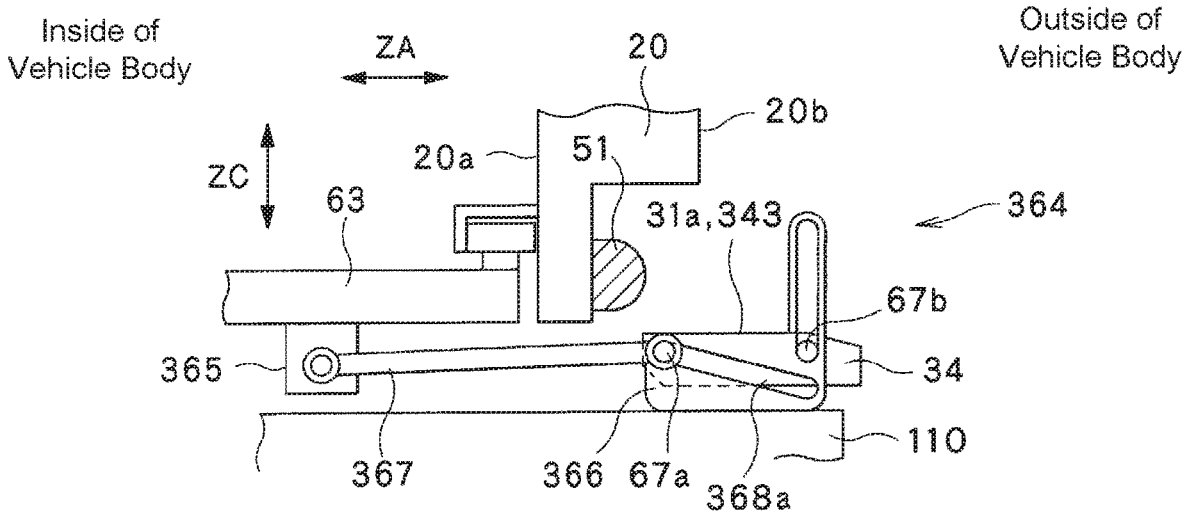
FIG. 9C is a side view showing the movable receiving portion being at the second receiving portion position.

Next, with reference to FIG. 9A to FIG. 9C, a description is given of a third modification example of the door device according to the present invention. The third modification example shown in FIG. 9A to FIG. 9C is different in that a so-called inside plug type door device is used and in that a transmission unit is configured differently. Other configurations are substantially the same as those in the embodiment shown in FIG. 1 to FIG. 6C.

A door device 320 shown in FIG. 9A to FIG. 9C is a so-called inside plug type door device as mentioned above. Therefore, in the door device 320, when the door 20 moves from the first door position shown in FIG. 9A to the second door position shown in FIG. 9C, the door 20 and the upper slide member 43 move in a direction from outside of the vehicle body 110 toward inside thereof. On the other hand, when the door 20 moves from the second door position to the first door position, the door 20 and the upper slide member 43 move in a direction from inside of the vehicle body 110 toward outside thereof. Therefore, the seal member 51 of the door 20 is provided on the outer surface 20*b* thereof. Furthermore, the receiving surface 31*a* of the opening frame 30, which is directly opposed to the door 20, faces inside of the vehicle body 110.

A transmission unit 364 of the door device 320 has a base 365 fixed to the lower slide member 63, a plate 366 provided adjacently to one end portion of the movable receiving portion 34, two pins 67*a* and 67*b* protruding from the one end portion of the movable receiving portion 34 toward the plate 366, and a link shaft 367 disposed between the pin 67*a* and the base 365. The plate 366 has a width direction opening 368*a* extending generally along the vehicle width direction ZA and a height direction opening 368*b* extending generally along the height direction ZC. The height direction opening 368*b* extends upward from a vicinity of an end portion of the width direction opening 368*a* near outside of the vehicle body 110. The pins 67*a* and 67*b* of the movable receiving portion 34 are disposed within the width direction opening 368*a* and the height direction opening 368*b*, respectively. The link shaft 367 is rotatably connected at one end thereof to the base 365 and rotatably connected at the other end thereof to the pin 67*a*.

Next, a description is given of an effect of the door device according to the third modification example.

First, as shown in FIG. 9A, in a case where the door 20 is at the first door position and the movable receiving portion 34 of the opening frame 30 is at the first receiving portion position at which the movable receiving portion 34 stands, the outer surface 20*b* of the door 20 is directly opposed to a surface 343 of the movable receiving portion 34, which faces inside of the vehicle body 110. Furthermore, the outer surface 20*b* of the door 20 and said surface 343 of the movable receiving portion 34, which faces inside, are tightly attached to each other via the seal member 51.

In a case where the door 20 being at the first door position is opened, as shown in FIG. 9B, the plug operation portion 45 is driven to cause the lower slide member 63 to slide toward inside of the vehicle body 110. Thus, the base 365 moves toward inside of the vehicle body 110. As shown in FIG. 9B, in accordance with movement of the base 365, the link shaft 367 is pulled toward inside of the vehicle body 110. Thus, the pins 67*a* and 67*b* of the movable receiving portion 34 move by being guided by the openings 368*a* and 368*b*, respectively. As a result, the movable receiving portion 34 rotates toward the second receiving portion position shown in FIG. 9C.

On the other hand, in a case where the door 20 being at the second door position is closed, as shown in FIG. 9B, the plug operation portion 45 is driven to cause the lower slide member 63 to slide toward outside of the vehicle body 110. Thus, the base 365 moves toward outside of the vehicle body 110. As shown in FIG. 9B, in accordance with movement of the base 365, the link shaft 367 is pushed toward outside of the vehicle body 110. Thus, the pins 67*a* and 67*b* of the movable receiving portion 34 move by being guided by the openings 368*a* and 368*b*, respectively. As a result, the movable receiving portion 34 rotates toward the first receiving portion position shown in FIG. 9A.

A similar effect to that of the door device according to the foregoing embodiment can be obtained also by the door device according to the third modification example.

Figure 10:
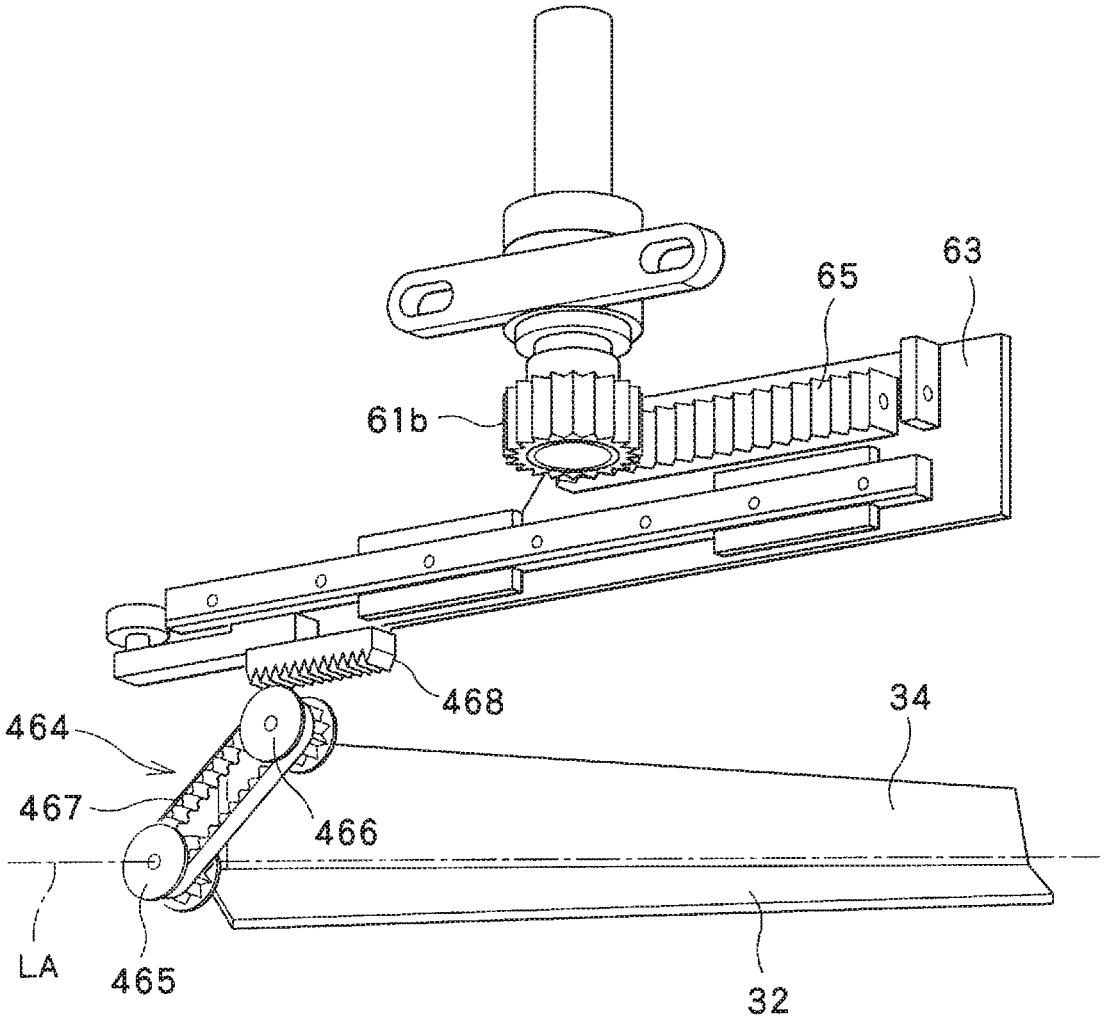
FIG. 10 illustrates a fourth modification example of the door device, showing a perspective view of a rotary drive portion that rotates the movable receiving portion.

Next, with reference to FIG. 10, a description is given of a fourth modification example of the door device according to the present invention. In the fourth modification example shown in FIG. 10, a transmission unit is configured differently, and other configurations are substantially the same as those in the embodiment shown in FIG. 1 to FIG. 6C.

A transmission unit 464 according to the fourth modification example includes a first pinion 465 fixed to one end portion of the movable receiving portion 34, a second pinion 466 disposed in a lower region of the lower slide member 63, a chain 467 wound around the first pinion 465 and the second pinion 466, and a rack 468 fixed to a lower end portion of the lower slide member 63 so as to be opposed to the second pinion 466.

The first pinion 465 is provided so as to be rotatable about the axis LA. The second pinion 466 is provided on the wall surface 111 of the vehicle body 110 and is rotatable about an axis parallel to the axis LA. The rack 468 causes the second pinion 466 to rotate in accordance with movement of the lower slide member 63.

Next, a description is given of an effect of the door device according to the fourth modification example.

In a case where the door 20 being at the first door position is opened, the plug operation portion 45 is driven to cause the lower slide member 63 to slide toward outside of the vehicle body 110. Thus, the rack 468 moves toward outside of the vehicle body 110. The second pinion 466 rotates in accordance with movement of the rack 468 The first pinion 465 rotates in tandem with the second pinion 466. As a result of rotation of the first pinion 465, the movable receiving portion 34 rotates to the second receiving portion position.

On the other hand, in a case where the door 20 being at the second door position is closed, the plug operation portion 45 is driven to cause the lower slide member 63 to slide toward inside of the vehicle body 110. Thus, the rack 468 moves toward inside of the vehicle body 110. The second pinion 466 rotates in accordance with movement of the rack 468 The first pinion 465 rotates in tandem with rotation of the second pinion 466. As a result of rotation of the first pinion 465, the movable receiving portion 34 rotates to the first receiving portion position.

A similar effect to that of the door device according to the foregoing embodiment can be obtained also by the door device according to the fourth modification example.

The embodiment of the present invention and several modification examples with respect to said embodiment described thus far are illustrative and not intended to limit the scope of the invention. This new embodiment and its modification examples may have various other forms and are susceptible to omission, replacement, and modification of various elements thereof within the scope of the invention. The foregoing embodiment and its variations are included in the scope and purport of the invention and are also included in the inventions recited in the claims and equivalents thereof.

What is claimed is:

1. A door device, comprising:

an opening frame defining an opening; and a door for operating between a first door position and a second door position, the door making contact with the opening frame when at the first door position, the door being separated from the opening frame when at the second door position, wherein a movable receiving portion constituted by at least part of the opening frame operates so that an area of the opening of the opening frame is larger when the door is at the second door position than when the door is at the first door position, wherein the opening frame includes a door receiving plate portion forming a circumferential receiving surface, the circumferential receiving surface coming in contact with a periphery of the door being at the first door position, and wherein the movable receiving portion constitutes part of the door receiving plate portion and comes in contact with the door being at the first door position.

2. The door device according to claim 1, wherein when the door moves from the second door position to the first door position, the movable receiving portion operate so as to narrow the opening of the opening frame.

3. The door device according to claim 1, wherein the movable receiving portion operates in accordance with an operation of the door between the first door position and the second door position.

4. The door device according to claim 1, further comprising:

a plug operation portion for operating the door between the first door position and the second door position; and a transmission unit provided between either the plug operation portion or the door and the movable receiving portion of the opening frame, the transmission unit transmitting an operation of either the plug operation portion or the door to the movable receiving portion.

5. The door device according to claim 1, wherein when the door moves from the first door position to the second door position, the movable receiving portion of the opening frame starts an operation after the door has started an operation from the first door position and moved a given distance.

6. The door device according to claim 1, wherein when the door moves from the first door position to the second door position, the movable receiving portion of the opening frame ends an operation before the door reaches the second door position.

7. The door device according to claim 1, wherein when the door moves from the second door position to the first door position, the movable receiving portion of the opening frame ends an operation before the door reaches the first door position.

8. The door device according to claim 1, wherein the movable receiving portion is rotatable about an axis non-parallel to a moving direction of the door between the first door position and the second door position.

9. The door device according to claim 1, wherein the movable receiving portion is rotatable about an axis along an extending direction of the opening frame.

10. The door device according to claim 1, wherein the opening frame further includes:

a support portion connected to the door receiving plate portion, and wherein, the movable receiving portion is operable between a first receiving portion position and a second receiving portion position, the movable receiving portion standing from the support portion when at the first receiving portion position, the movable receiving portion being lowered when at the second receiving portion position.

11. The door device according to claim 10, wherein the movable receiving portion being at the first receiving portion position is attached to the support portion in a region along an extending direction of the opening frame.

12. The door device according to claim 1, wherein the door receiving plate portion further includes a stationary receiving portion maintained in a stationary state while the door operates between the first door position and the second door position, and wherein, when the door is at the first door position, an end portion of the stationary receiving portion along an extending direction of the opening frame and an end portion of the movable receiving portion along the extending direction are directly opposed to each other in a moving direction of the door operating between the first door position and the second door position.

13. The door device according to claim 12, wherein a seal member is provided between the end portion of the stationary receiving portion and the end portion of the movable receiving portion.

14. The door device according to claim 1, wherein the door device is used for a vehicle.

15. A vehicle, comprising:

a vehicle body; and a door device of claim 1 installed in the vehicle body.

* * * * *